US005233718A

United States Patent [19]

Hardaway et al.

[11] Patent Number: 5,233,718

[45] Date of Patent: * Aug. 10, 1993

[54] TUMBLE METHOD OF RINSING FABRIC IN A HORIZONTAL AXIS WASHER

[75] Inventors: Anthony H. Hardaway, Lincoln Township, Berrien County; Mark B. Kovich, St. Joseph Township, Berrien County; Sheryl L. Farrington, Lincoln Township, Berrien County; Jim J. Pastryk, Weesaw Township, Berrien County; Jeanne C. Van Newenhizen, Benton Township, Berrien County; John W. Euler, St. Joseph, all of Mich.

[73] Assignee: Whirlpool Corporation, Benton Harbor, Mich.

[ * ] Notice: The portion of the term of this patent subsequent to Mar. 9, 2010 has been disclaimed.

[21] Appl. No.: 815,782

[22] Filed: Jan. 2, 1992

[51] Int. Cl.[5] ..... D06B 1/02; D06F 23/02

[52] U.S. Cl. ..... 8/158; 8/159; 68/23.5; 68/58

[58] Field of Search ..... 8/158, 159; 68/23.5, 68/12.14, 58

[56] References Cited

U.S. PATENT DOCUMENTS

| | | | |
|---|---|---|---|
| 2,966,052 | 12/1960 | Syles | 68/58 |
| 3,197,980 | 8/1965 | Marple | 68/12 |
| 3,650,673 | 3/1972 | Ehner | 8/137 |
| 3,811,300 | 5/1974 | Barton et al. | 68/12 R |
| 4,118,189 | 10/1978 | Reinwald et al. | 8/137 |
| 4,432,111 | 2/1984 | Hoffmann et al. | 8/158 |
| 4,489,455 | 12/1984 | Spendel | 8/158 |
| 4,489,574 | 12/1984 | Spendel | 68/16 |
| 4,696,171 | 9/1987 | Babuin | 68/207 |
| 4,784,666 | 11/1988 | Brennen et al. | 8/158 X |
| 4,987,627 | 1/1991 | Cur et al. | 8/158 |

FOREIGN PATENT DOCUMENTS 209436 7/1957 Australia .

*Primary Examiner*—Theodore Morris
*Assistant Examiner*—Saeed T. Chaudhry
*Attorney, Agent, or Firm*—Stephen D. Krefman; Thomas J. Roth; Thomas E. Turcotte

[57] ABSTRACT

The present invention contemplates a rinse process which can be used with any wash cycle, but which has particular utility following a wash cycle have a highly concentrated detergent solution.

The method of rinsing fabric provided by the present invention is useful in a washer having a wash chamber rotatable about a horizontal axis. The steps undertaken in the method begin with loading fabric to be washed into the wash chamber of the washer. The fabric is then washed in a detergent solution while rotating the wash chamber about its horizontal axis for a first period of time. Next the detergent solution is drained from the wash chamber. The fabric is then rinsed by adding water to the wash chamber while spinning the wash chamber at a speed to effect less than a one gravity centrifugal force on the fabric such that the fabric will tumble within the wash chamber as it spins. Finally, the wash chamber is drained of the rinse water.

22 Claims, 6 Drawing Sheets

TUMBLE METHOD OF RINSING FABRIC IN A HORIZONTAL AXIS WASHER

BACKGROUND OF THE INVENTION

The present invention relates to a method of rinsing fabric in an automatic clothes washer and more particularly to a spinning and tumbling rinse method in a horizontal axis clothes washer.

Attempts have been made to provide an automatic clothes washer which provides comparable or superior wash results to present commercially available automatic washers, yet which uses less energy and water. For example, such devices and wash processes in a vertical axis machine are shown and described in U.S. Pat. Nos. 4,784,666 and 4,987,627, both assigned to the assignee of the present application, and incorporated herein by reference.

The basis of these systems stems from the optimization of the equation where wash performance is defined by a balance between the chemical (the detergent efficiency and water quality), thermal (energy to heat water), and mechanical (application of fluid flow through—fluid flow over—fluid impact—fabric flexing) energy inputs to the system. Any reduction in one or more energy forms requires an increase in one or more of the other energy inputs to produce comparable levels of wash performance.

U.S. Pat. No. 4,489,455 discloses a horizontal axis washer which utilizes a reduced amount of wash fluid in a washing cycle in which the wash fluid is applied on to the fabric load and then the load is tumbled in the presence of the wash fluid for a given period of time. Recirculation of the wash liquid does not occur.

U.S. Pat. No. 3,197,980, assigned to the assignee of the present invention, discloses a horizontal washer and wash cycle in which the clothes load is subjected first to a deep fill to thoroughly wet all of the clothes, half the water is then removed from the washer and a normal detergent supply is introduced into the remaining wash bath. Thus, a "concentrated" detergent solution in the range of 0.40 to 0.50% by weight is applied to the clothes load during a tumbling agitation of the clothes. Recirculation of the wash fluid during this "concentrated" wash cycle is also disclosed. Following the "concentrated" portion of the wash cycle, the tub is refilled to a deep fill volume which dilutes the detergent concentration to the normal concentration of 0.20 to 0.25%. An additional tumble period at the normally recommended detergent concentration then occurs.

Various rinse techniques have been proposed for removing detergent and dirt from the clothes load after the washing cycle, however, most of those rinse methods use a large amount of water or are not effective to remove a highly concentrated detergent solution or avoid redeposition of removed dirt onto the clothes load.

Significantly greater savings in water usage and energy usage than is achieved by heretofore disclosed wash systems and methods would be highly desirable.

SUMMARY OF THE INVENTION

A horizontal axis washer system incorporating the principles of the present invention utilizes a basket structure and fluid conduits and valves which complement specifically increasing the level of chemical contributions to the wash system, therefore permitting the reduction of both mechanical and thermal inputs.

The utilization of concentrated detergent solution concepts in the wash portion of the cycle permits the appliance manufacturer to significantly reduce the amount of thermal and mechanical energy applied to the clothes load, through the increase of chemistry a minimum of thirteen fold and maximum up to at least sixty-four fold, while approximating "traditional" cleaning levels, yet reducing the energy and water usage. This translates to washing with reduced water heating, reduced water consumption, and minimal mechanical wash action to physically dislodge soils. A concentrated detergent solution is defined in U.S. Pat. No. 4,784,666 as 0.5% to 4% detergent by weight. It is anticipated now, however, that a concentrated detergent solution may be as high as 12% by weight.

The present invention contemplates a rinse process which can be used with any wash cycle, but which has particular utility following a wash cycle have a highly concentrated detergent solution.

The method of rinsing fabric provided by the present invention is useful in a washer having a wash chamber rotatable about a horizontal axis. The steps undertaken in the method begin with loading fabric to be washed into the wash chamber of the washer. The fabric is then washed in a detergent solution while rotating the wash chamber about its horizontal axis for a first period of time. Next the detergent solution is drained from the wash chamber. The fabric is then rinsed by adding water to the wash chamber while spinning the wash chamber at a speed to effect less than a one gravity centrifugal force on the fabric such that the fabric will tumble within the wash chamber as it spins. Finally, the wash chamber is drained of the rinse water.

DESCRIPTION OF THE PREFERRED EMBODIMENTS

Washer and Fluid Flow Path Construction

Figure 1:
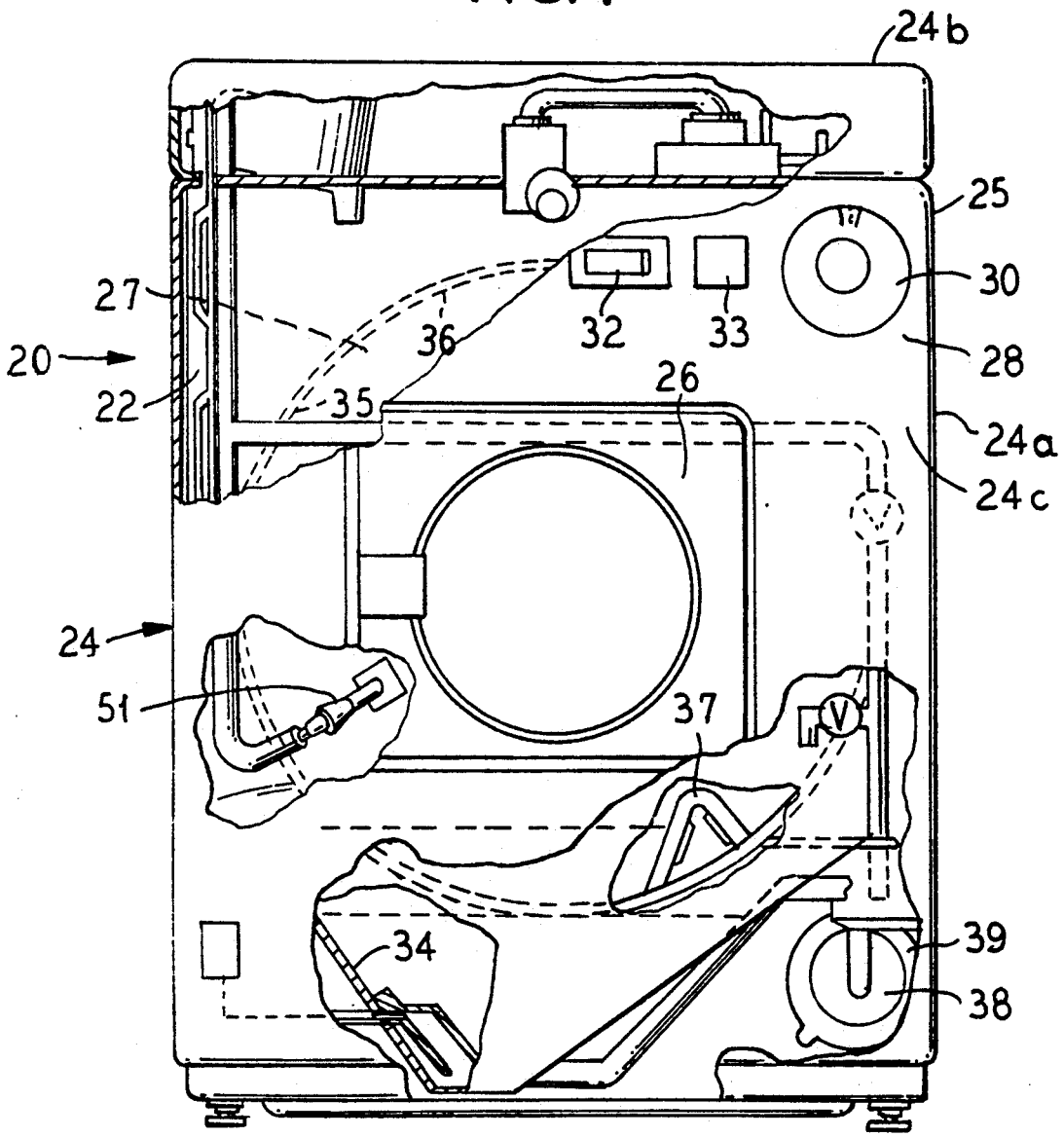
FIG. 1 is a front view of an automatic washer, partially cut away to illustrate various interior components.
Figure 2:
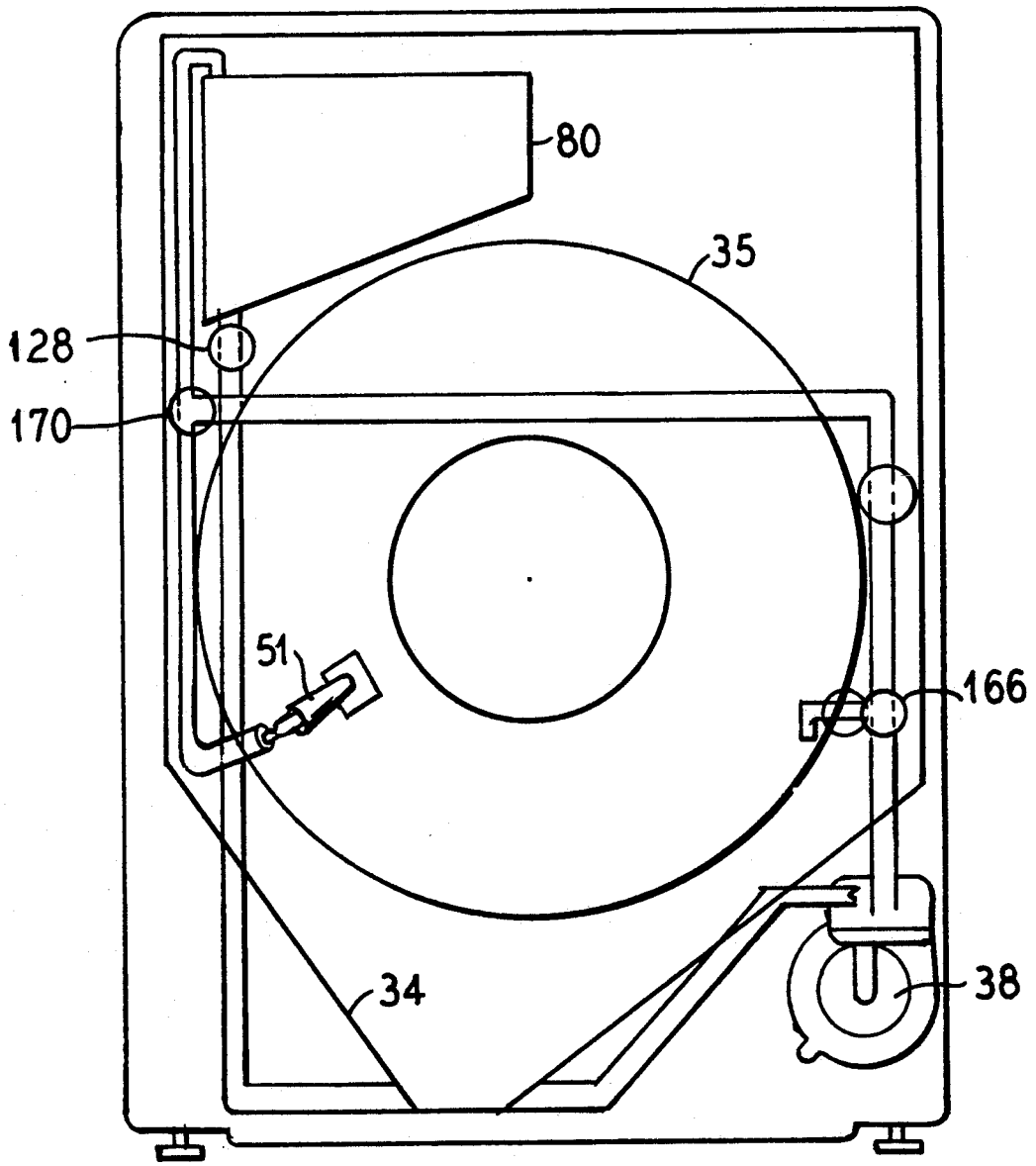
FIG. 2 is a partial front elevational view of the washer of FIG. 1 with the outer wrapper removed to illustrate the interior components.

In FIG. 1, reference numeral 20 indicates generally a washing machine of the automatic type, i.e., a machine having a pre-settable sequential control means for operating a washer through a preselected program of automatic washing, rinsing and extracting operations in which the present invention may be embodied. The machine 20 includes a frame 22 carrying vertical panels 24 forming the sides 24*a*, top 24*b*, front 24*c* and back of the cabinet 25 for the washing machine 20. A hinged door 26 is provided in the usual manner to provide access to the interior or treatment zone 27 of the washing machine 20. The washing machine 20 has a console 28 including a timer dial 30 or other timing mechanism and a temperature selector 32 as well as a cycle selector 33 and other selectors as desired.

Internally of the machine 20 described herein by way of exemplifications, there is disposed an imperforate fluid containing tub 34 within which is a spin basket 35 with perforations or holes 36 therein, while a pump 38 is provided below the tub 34. The spin basket 35 defines a wash chamber. A motor 39 is operatively connected to the basket 35 to rotate the basket relative to the stationary tub 34.

Figure 3:
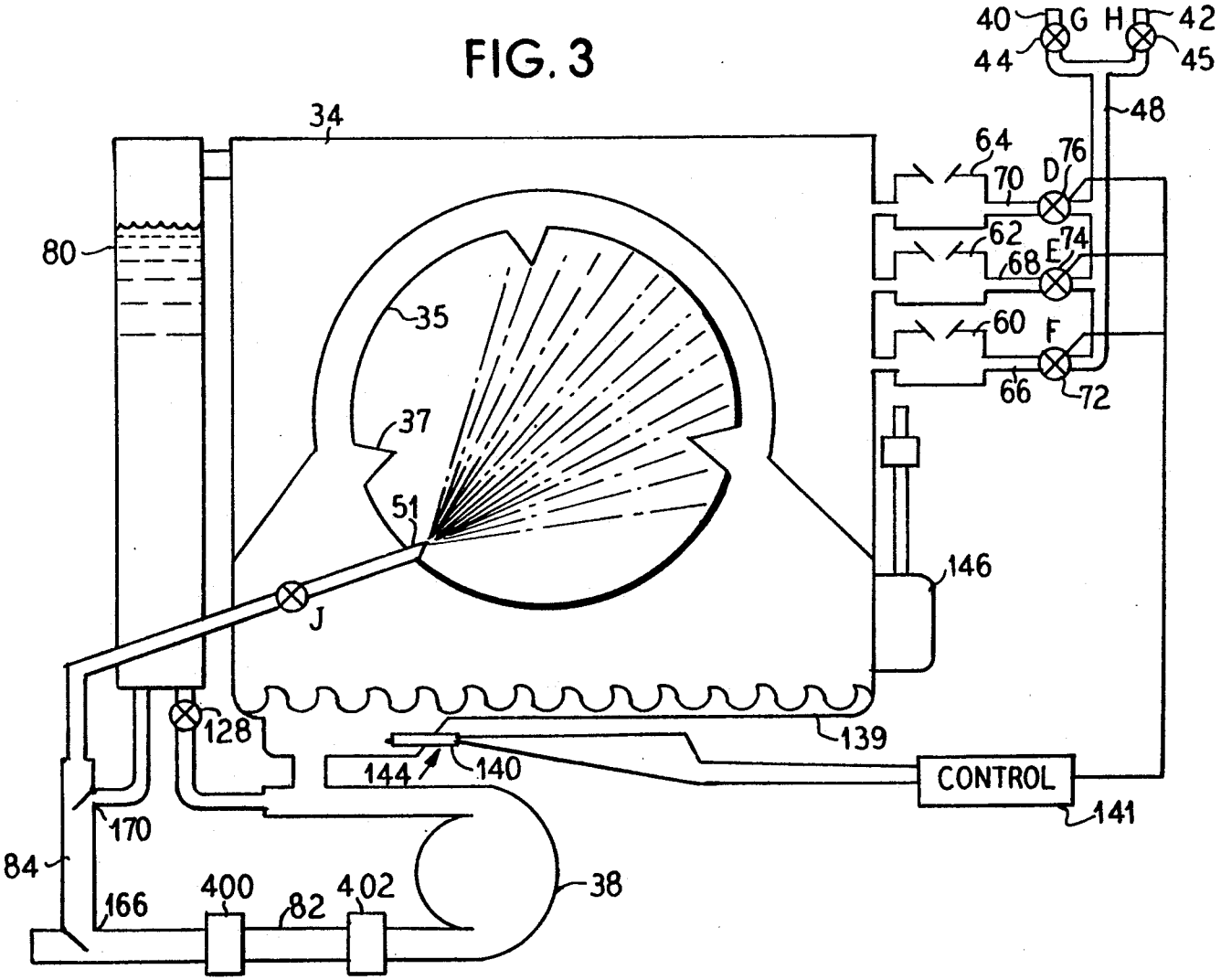
FIG. 3 is a schematic illustration of the fluid conduits and valves associated with the automatic washer.

Water is supplied to the imperforate tub 34 by hot and cold water supply inlets 40 and 42 (FIG. 3). Mixing valves 44 and 45 in the illustrated dispenser design are connected to conduit 48. There are provided a plurality of wash additive dispensers 60, 62 and 64 as seen in FIG. 3. Dispensers 60 and 62 can be used for dispensing additives such as bleach or fabric softeners and dispenser 64 can be used to dispense detergent (either liquid or granular) into the wash load at the appropriate time in the automatic: wash cycle. As shown schematically in FIG. 3, each of the dispensers 60, 62 and 64 are supplied with liquid (generally fresh water or wash liquid) through a separate, dedicated conduit 66, 68, 70 respectively. Each of the conduits 66, 68 and 70 may be connected to a fluid source in a conventional manner, as by respective solenoid operated valves (72, 74 and 76 FIG. 3), which contain built-in flow devices to give the same flow rate over wide ranges of inlet pressures, connecting each conduit to the manifold conduit 48.

A mixing tank 80, as shown in FIG. 3, forms a zone for receiving and storing a concentrated solution of detergent during the wash cycle, and is used in some embodiments of the invention. As will be described in greater detail below, the mixing tank 80 communicates at a top end with the wash tub 34 and at a lower end communicates with the pump 38, a drain line or conduit 82 and a recirculating conduit 84. The mixing tank 80 may be similar to that disclosed in U.S. Pat. No. 4,784,666.

As described above, the detergent dispenser 64 is provided with a supply of fresh water through conduit 70. Other types of detergent dispensers can, of course, be used with the present invention, including dispensers which hold more than a single charge of detergent and dispense a single charge for each wash cycle.

Positioned within the tub 34, near a bottom wall 139 thereof is a liquid sensor means which may be in the form of a liquid level sensor 140. Such a sensor can be of a number of different types of sensors including a conductivity probe 142 (FIG. 5A), a temperature thermistor 144 (FIG. 3) or a pressure dome 146 (FIG. 5B). Regardless of the liquid sensor type, the liquid sensor must be able to detect either the presence of liquid detergent solution and/or the presence of suds within the tub. A sensor which detects the depth of liquid within the tub may also be utilized. When the sensor makes the required detection, it sends an appropriate signal to a control device 141, as is known in the art, to provide the appropriate control signals to operate the various valves as required at that portion of the wash cycle. As is described in greater detail below, the liquid sensor 140 is used to maintain a desired level of wash liquid within the tub 34 during the recirculating portion of the concentrated wash cycle.

Figure 5A:
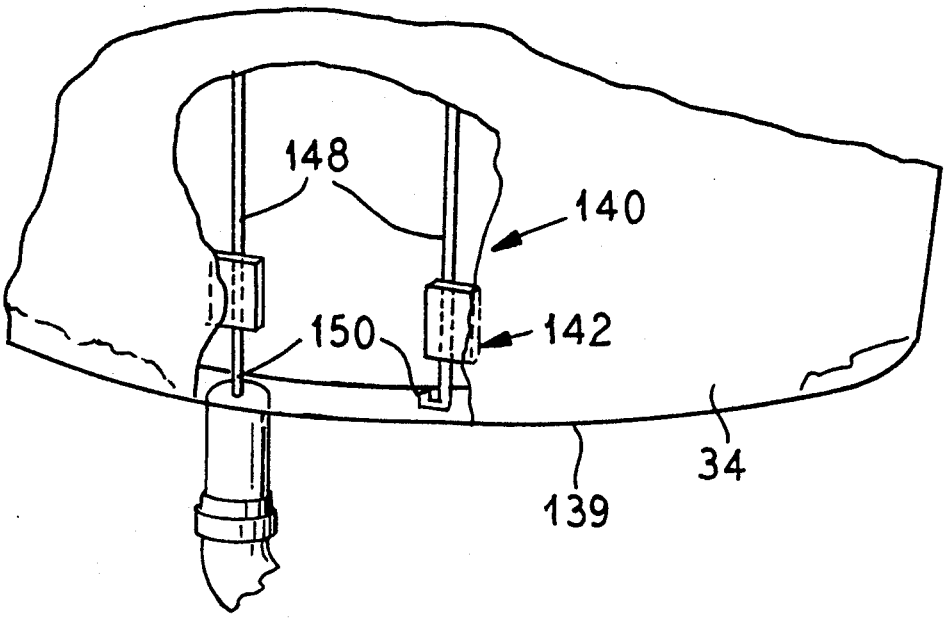
FIG. 5A is a sectional view of the wash tub illustration an electrical probe liquid level sensor.
Figure 5B:
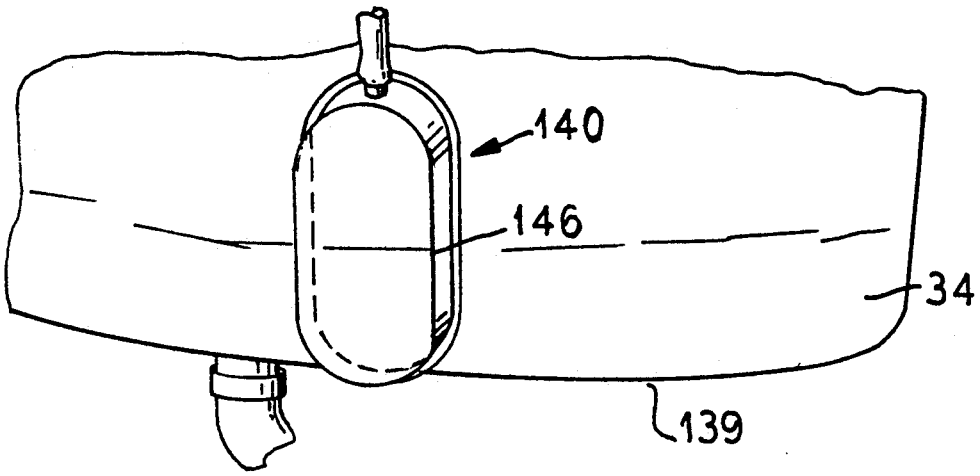
FIG. 5B is a side sectional view of the use of a pressure dome as a liquid level sensor in the wash tub.

The probe sensor 142, shown in FIG. 5A, consists of two insulated stainless steel electrodes 148 having only the tips 150 exposed in the tub 34. When the detergent solution or suds level raises high enough to contact both electrodes, the low voltage circuit is completed indicating the sensor is satisfied.

A thermistor system 144, as generally indicated in FIG. 3, is also located in the tub 34 and is triggered when the water or suds level rises to the designated level, thus cooling the sensor element.

A pressure dome sensor 146, as shown in FIG. 5B and FIG. 3, is similar to pressure domes normally utilized determining liquid level within an automatic washer tub, however it is the positioning of the dome near the bottom of the tub 34 or in a sump, rather than on the upper side of the tub which is the major difference between its usage here and its traditional usage. If a pressure dome sensor 146 is utilized, it must have a setting for spin/spray usage. An indirect inference of water level in the tumble portion of the cycle based on the level of the detergent liquor can be used via algorithms. A pressure dome sensor may also be beneficial as a sensor to detect an over sudsing condition. If the suds level is too high, then the sensor does not reset. The failure to reset is a means for terminating a spray/-spin wash proceeding with the tumble portion of the wash cycle.

Basket Construction

The washer basket 35 has a plurality of inwardly directed baffles 37 to engage and lift the fabric as the basket rotates about its horizontal axis. The wash basket also is provided with a series of apertures 36 therethrough to permit fluid flow through the basket. When the basket rotates at a sufficiently high speed, the fabric will be held against the wall of the basket in that a centrifugal force in excess of the force of gravity will be applied to the fabric, thus preventing the fabric from moving relative to the basket wall. However, when the basket is rotated below a predetermined speed, less than one gravity of centrifugal force will be applied to the fabric, thus permitting the fabric to tumble within the basket. As described below, one or both of these spin actions may be applied during the preferred wash cycle.

An optional in-line water heater 400 (FIG. 3), or an immersion heater in the sump, offers the ability to increase the concentrated wash liquor to an elevated temperature level, thus providing high temperature wash performance at the reduced cost of heating one to one and half gallons of water. This compares to the cost of heating four to five gallons of water in a traditional horizontal washer. The controlled use of an in-line heater 400 combined with high concentrated wash liquor offers special opportunities for specific optimization of detergent ingredients which are activated only in specific temperature ranges. Furthermore, the elevated water temperatures offer the ability to specifically target oily soil removal and reduce the build-up of both saturated and poly-unsaturated oils in fabrics laundered in cold water.

The use of an in-line lint, button, sand and foreign object trap or filter 402 significantly reduces the potential for problems associated with recirculating fluid systems carrying soils and foreign materials. Such a filter is disclosed in U.S. Pat. No. 4,485,645, assigned to the assignee of the present invention, and incorporated herein by reference. Such optional devices would be utilized in a preferred system.

Wash Cycle

Figure 4:
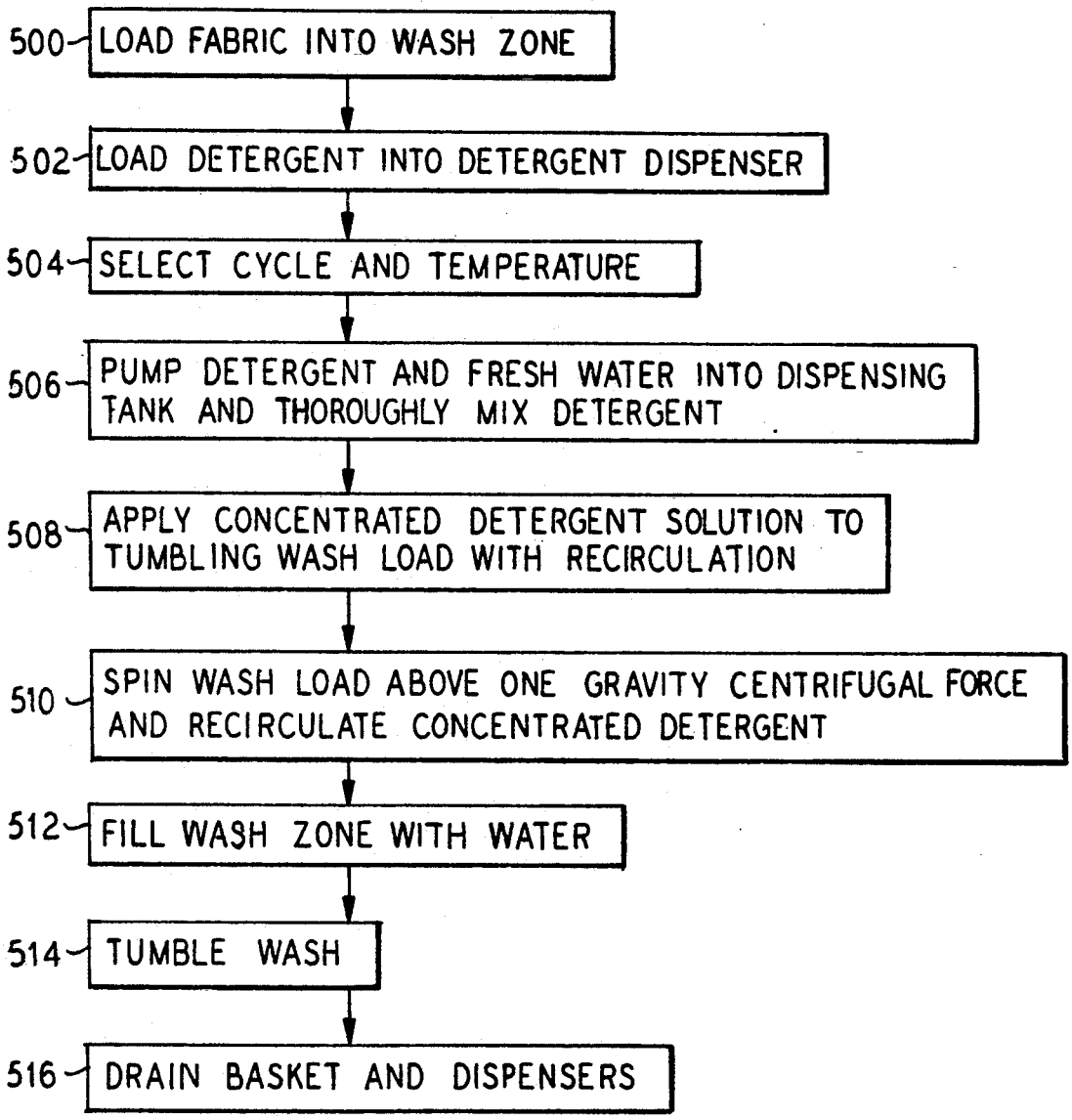
FIG. 4 is a flow chart diagram of the steps incorporated in the concentrated wash cycle.

An improved wash and rinse cycle is provided in accordance with the present invention and is shown schematically in FIG. 4. In step 500, the washer is loaded with clothes as would be standard in any horizontal axis washer. In step 502, the detergent; liquid, powdered, and/or other detergent forms, is added to the washer, preferably through a detergent dispenser, such as the detergent dispenser 64 illustrated, and mixing tank, such as tank 80, at the dosage recommended by the detergent manufacturer for a particular sized wash load. It is possible to add the detergent directly to washer through the basket or directly into the tub through a direct path. The consumer then selects the desired cycle and water temperature in step 504.

A 3-way drain valve 166 and a 3-way detergent mixing valve 170 are turned on and the detergent tank control valve 128 and the detergent water valve 76 are opened. A time delay (approximately 30 seconds) is used to input wash water after which the detergent water valve 76 is closed. As the washer fills, the detergent is washed from the dispenser 64 into the tub 34, past the drain and mixing tank valves 166, and into the mixing tank 80. A time delay (approximately 15 seconds) provide mixing of the detergent with wash water by recirculating the solution in a loop controlled by the valves as indicated by step 506. The detergent is only diluted to a highly concentrated level of approximately 0.5 to 12% by weight detergent. The washer basket 35 begins a low speed spin. The preferred speed allows uniform coverage of the concentrated detergent liquor onto the clothes load. Concentrated Wash Cycle In step 508, the detergent tank control valve 128 is closed and a time delay of approximately 15 seconds, but dependent on the size of the mixing tank 80, causes the mixing tank to fill with the detergent solution. The detergent mixing valve 170 is turned off permitting the detergent solution to leave the closed loop and to be sprayed onto the spinning clothes load via a nozzle 51 whose arrangement can be from any point internal to the basket. The preferred position provides a spray pattern perpendicular to the clothes load tumbling path in both bidirectional and unidirectional tumbling systems.

During the initial introduction of concentrated detergent solution on to the clothes load, the wash basket is spun at a speed slow enough to effect less than a one gravity centrifugal force on the clothes load, thus resulting in the clothes load tumbling within the basket. After the concentrated detergent solution is sprayed on the clothes, the solution then travels through the basket 35, into the tub 34, down through the pump 38 to be sprayed through the nozzle 51 creating a recirculation loop. The preferred system utilizes a pump exclusively for the recirculation. This ensures sufficient concentrated liquid flow rates without losses due to slower pump speeds associated directly with the drive system. Less effective systems could also use the main pump of the wash system.

This step concentrates the effectiveness of the chemistry thus permitting maximum soil removal and minimum soil redeposition even under adverse washing conditions. The high concentrations of detergent ingredients significantly increases the effectiveness of micelle formation and sequestration of oily and particulate soils and water hardness minerals, thus providing improved performance of surfactants, enzymes, oxygen bleaches, and builder systems beyond level achievable under traditional concentrations.

The water level sensor 140, located near the tub bottom, or in the sump, begins to monitor water level concurrent with the opening of the detergent mixing valve 170. Water level control is critical. Too much detergent solution added will create an over sudsing condition by allowing the spinning basket to contact detergent solution in the bottom of the tub. The preferred method of control is to maintain a minimum level of detergent liquor in the bottom of the tub through the water level sensor. While results suggest that some type of tub modifications (resulting in a sump) permits the washer to function under a wide range of conditions, there are many more common conditions which do not require a tub sump.

A satisfied sensor 140 indicates the system does not require any additional detergent solution at this point in the cycle and the detergent tank valve 128 is closed to maintain the current level of detergent. A satisfied water level sensor 140 early in the wash cycle generally indicates either a no clothes load situation or a very small clothes load. If the sensor is not satisfied, then the detergent tank control valve 128 is opened permitting the addition of detergent solution followed by a five second time delay before again checking the water level sensor 140. If the sensor 140 is satisfied, the detergent tank control valve 128 is closed to maintain the new level of detergent and a thirty second time delay begins to permit the clothes load a chance to come to equilibrium with respect to water retention and the centrifugal forces of extraction created by the spinning basket.

In the preferred embodiment of the invention a mixing tank in not utilized, rather, the detergent is mixed in the bottom of the tub or in the sump if there is one. The water level control is provided by a pressure switch in the bottom of the tub, or in the sump, which does provide water level control as a function of clothes load.

In a preferred wash method, the spin speed is then increased to a level to cause a centrifugal force to be applied against the clothes load in excess of one gravity so that the clothes load will be held against the spinning basket wall. The concentrated detergent solution is forced through the clothes load and through the basket holes due to the centrifugal forced imparted by the spinning basket with potential significant contributions by mechanical fluid flow through the fabric defined by the pumping rate of the detergent liquor. During this step (510) the concentrated detergent solution will be recirculated through the clothes load for some predetermined period of time specified by the cycle type. That is, a cycle seeking maximum performance may recirculate the detergent solution through the clothes for 14 minutes or more, while a more delicate or less soiled load will attempt to minimize the length of spinning. The water level sensor 140 monitors the tub 34, adding additional detergent solution from the mixing tank 80 as required. The larger the clothes load the more detergent solution is required. Once the mixing tank 80 is emptied, fresh water is added through the detergent water valve 40,42 and 76 as required by the water level sensor 140.

Tumble Wash Cycle

The high speed spin/recirculation portion of the cycle is terminated after the designated time and the detergent tank control valve 128 is opened with a five second time delay to permit the draining of any remaining detergent solution into the tub 34. The detergent mixing valve 170 is turned on and the detergent water valves and water fill valves 45, 76 are opened to rinse out the detergent mixing tank 80 and begin a dilution fill as shown in step 512.

The fill volume for the tumble wash for step 514 can be indirectly inferred through volume of water used in the concentrated spray wash portion of the cycle in a system utilizing computer control. In more traditional electromechanical control systems, some other method or methods must be used to regulate the fill; i.e., flow regulated timed fill for maximum load volumes, motor torque, and pressure switches.

This second concentrated detergent solution spray portion of the wash cycle differs from the first in that the spin speed should now be reduced below that which will create a one gravity centrifugal force, to ensure the clothes load can loosely tumble, while a somewhat diluted yet still concentrated spray liquor is applied. In this step (514), the concentrated detergent solution is diluted somewhat, but not so much as to reduce the concentration to the normal concentration level of 0.05–0.28%. Thus, the detergent concentration in this step will be above 0.28%. The additional water dilution is necessary due to the reduced extraction in the tumble mode versus the high speed spin mode. That is, with the centrifugal force reduced, the clothes load will hold a greater volume of wash fluid prior to saturation. This preferred second mode permits a further improvement in the level of uniformity of application of concentrated liquor and ultimately the uniform removal of soils. During the second mode of concentration liquor application, significant performance levels can be achieved due to specific designing/engineering of the application of thermal inputs to capitalize on the chemical benefits for specific detergent components not normally available in traditional horizontal wash systems.

The utilization of the recirculated spray throughout the tumble portion of the wash recycles wash liquor draining through holes 36 in either the fully perforated basket or the nearly solid basket provides water conservation, and further assists in the application of wash liquor flow through and over the wash load. The hardware utilized for the concentrated spray wash portion of the cycle effectively fits the requirements.

There are opportunities for modifications to the tub and sump to minimize suds lock conditions and more efficient spray applications by directing the wash liquor return directly and promptly to the pump with minimal aeration of the detergent liquor. Accumulation of concentrated detergent liquor in areas other than the orifice to the pump, such as between the tub and the basket, increases the risk of the spinning/tumbling basket contacting the liquor and mechanically aerating it to the point which negatively affects recirculated spray flow patterns and remaining detergent liquor throughout the recirculation plumbing.

The tumbling portion of the cycle has the objective to provide sufficient detergent liquor fluid flow "through" and "over" the clothes load combined with fabric flexing and flagging. The resulting wash liquor flow patterns appear as complex non-laminar flow, fundamental in classical removal of micelle formations sequestering both oily and particulate soils.

One of the objectives of this wash system is to minimize water consumption. While the preferred design utilizes a perforated basket, other system could utilize nearly solid baskets. Opportunities by a near solid basket include increased ease of maintain concentrated wash liquor in the clothes load and basket. The lack of basket holes reduces the rate and level of extraction of wash liquor and allows the wash liquor to increase its contact time with the clothes instead of reduced contact time required for recirculation through plumbing.

Other designs utilize non-perforated baskets or nearly solid baskets without recirculation. Such designs increase the ability of the system to achieve higher levels of chemical effectiveness in the basket and the clothes load without losses due to plumbing hardware. These washability performance achievements and accompanying reductions in the total water consumption are obtained by the elimination of the volume of the recirculation system, thus the remaining chemistry is concentrated in a lower volume of water.

The gentle tumbling wash action even of this elevated detergent concentration solution provides barely enough mechanical energy input to offer consumers only a minimally acceptable wash performance. Thus, the preferred cycle includes the use of an initial highly concentrated detergent solution wash step as described above.

The type and length of tumbling action varies with the cycle desired. For example, maximum time may be selected for maximum soil removal, while lesser times offer less fluid flow and fabric flexing for delicates, silks, wools, sweaters, and other fine washables. If bleach is being added, then valves 45, 74 are opened to allow a maximum of one quarter cup of liquid chlorine bleach. The physical size of the bleach dispenser 62 can be used to prevent over dosage or a bulk dispenser can be used to regulate dispensing at the appropriate ratio to the volume of water used in the concentrated detergent solution tumble portion of the wash cycle.

In some embodiments where extremely high temperatures are used during the tumble wash, water is added at the end of the tumble wash cycle to cool the clothes load, and the wash water.

The end of the concentrated tumble wash is characterized by a tumble drain followed by complete extraction of wash liquor from the clothes load, basket 35 and tub 34 in step 516. The spin speeds are staged so that the load balances itself and reduces the undesired opportunities for suds lock conditions.

All systems described above can use either spray, spray tumble, flush rinses, and/or combinations for effective rinsing and water conservation. The perforated basket design can also use a flush rinse technique.

THE RINSE CYCLE

Recirculated Spray Rinse Cycle

Figure 6A:
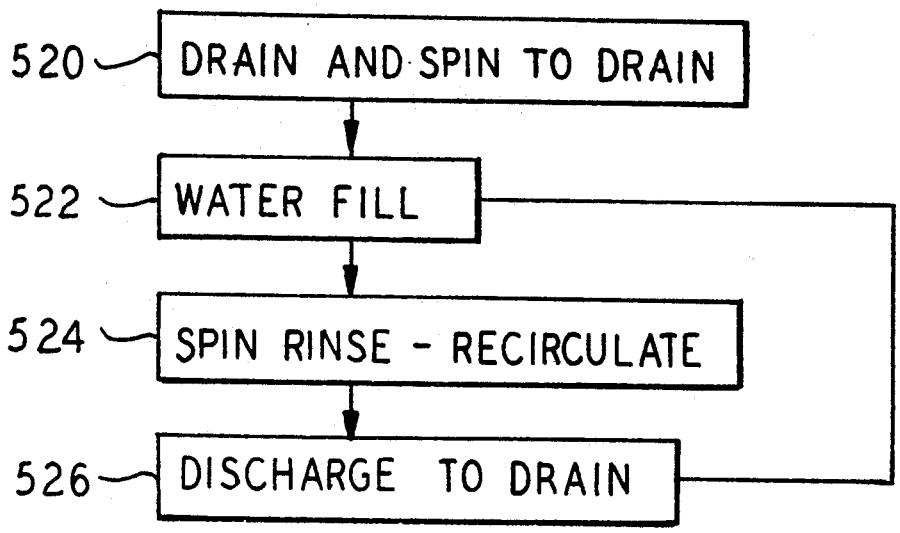
FIG. 6A is a flow chart diagram of a recirculation rinse cycle.

The recirculated spray rinse portion of the cycle, whether the basket is spun at a high speed to effect a centrifugal force greater than gravity or a slower speed to cause the fabric load to tumble as illustrated in FIG. 6A, represents a water conservation feature for any horizontal axis washer. Its preferred usage is in combination with concentrated detergent solution concepts to reduce the risk of potential soil redeposition, but is not limited to those designs or methods. The exact hardware utilized for high performance spray washing can be utilized without modification to provide rinsing performance comparable to a classical deep tumble rinse of approximately twenty gallons. The horizontal recirculated spray rinse cycle uses six to twelve serial recirculated spray rinse cycles, consuming approximately one gallon of water each, to provide rinsing, defined by removal of LAS containing surfactants, of a level comparable to that achieved by three to five deep tumble rinses of four to five gallons each. A combination of spin recirculated and tumble recirculated rinses provides more uniform rinsing with improved uniformity of final results.

The basket continues to spin after the final extract of the wash liquor with a fifteen second time delay to assure that all of the wash liquor has been pumped down the drain as shown in step 520. In step 522, the cold water valve 45 and 76 are opened until the water level sensor 140 is satisfied and then closed.

In step 524, the fresh water is sprayed directly onto the spinning clothes load. The water dilutes the detergent in the clothes as it passes through the load and basket. The rinse water drains down into the tub and is pumped back through the nozzle 51 to form a recirculation loop. The solution extracts additional detergent from the load with each pass. Each recirculation loop is delayed thirty seconds, after which the drain valve 166 is turned off and the solution is discharged to the drain as shown in step 526. The drain valve 166 is turned on and the spray rinse loop is repeated for the specified number of spray recirculations.

In the preferred embodiment, rinse water is added while the clothes tumble in the basket, and water is sprayed on the clothes load. When the water level control is satisfied, the basket accelerates to a speed sufficient to effect a centrifugal force in excess of one gravity. After some time, the rinse water is drained and the basket slows to tumble speed. The cycle is repeated for the specified number of spray recirculations.

On the last spray rinse the fabric softener valve 72, and cold water fill valve 45 is opened for thirty seconds permitting the fabric softener to be rinsed into the tub 34 and pump 38. Cold water and fabric softener valves 45, 72 are closed and the fabric softener is mixed with the last recirculating rinse water. The resulting solution is sprayed onto the clothes load in a recirculation loop for an additional two minutes to assure uniform application of the fabric softener. Additional fresh water is added through the cold water fill valve 42 if the water level sensor 140 becomes unsatisfied. In the final step 526, the drain valve 166 is turned off permitting the final extraction of water and excess softener for sixty seconds.

SPRAY FLUSH RINSE CYCLE

Figure 6B:
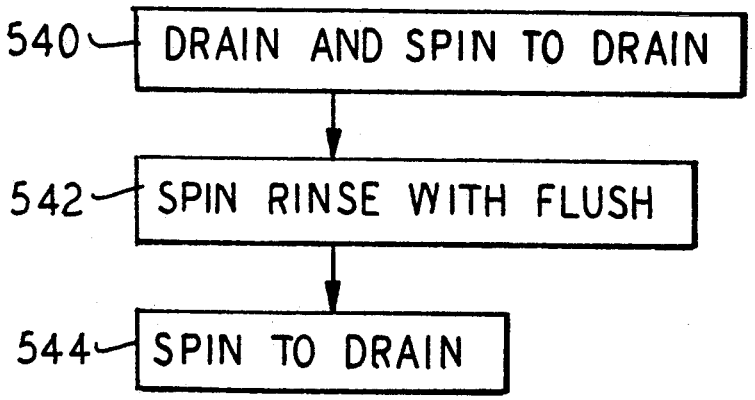
FIG. 6B is a flow chart diagram of a flush rinse cycle.

Spray flush as shown in FIG. 6B offer a less than optimum performance option for perforated basket designs. The limiting parameter for this system results from the lack of uniform spray coverage and problems associated with the lack of guaranteed water line pressures. The design does not require any additional hardware and consumes small volumes of water in matching the rinse performance of a deep rinse.

In step 540 the basket 35 continues to spin after the final extract of the wash liquor with a fifteen second time delay to assure all of the wash liquor has been pumped down the drain. The cold water valve 45 is opened until the timer is satisfied and then closed. In step 542, the fresh water is sprayed directly onto the spinning clothes load and directly down the drain by means of the closed drain valve 166. On the last flush spray rinse the fabric softener valve 72 and fill valve 45 are opened for thirty seconds permitting the fabric softener to be rinsed into the tub 34 and pump. Cold water and fabric softener valves 45, 72, are closed and the fabric softener is mixed with the last recirculating rinse water. The resulting solution is sprayed onto the clothes load in a recirculation loop for an additional two minutes to assure uniform application of the fabric softener. Additional fresh water is added through the cold water fill valve 45 if the water level sensor 140 becomes unsatisfied. The drain valve 166 is turned off permitting the final extraction of water and excess softener for sixty seconds in step 544.

As is apparent from the foregoing specification, the invention is susceptible of being embodied with various alterations and modifications which may differ particularly from those that have been described in the preceding specification an description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method of rinsing fabric in a washer having a wash chamber rotatable about a horizontal axis comprising the steps:

(a) loading fabric to be washed into the wash chamber of said washer;

(b) washing said fabric in a concentrated detergent solution of at least 0.5% detergent by weight while rotating said wash chamber about said horizontal axis for a first period of time;

(c) draining said concentrated detergent solution from said wash chamber subsequent to said first period of time while spinning said wash chamber at a speed to effect more than a one gravity centrifugal force on said fabric such that said fabric will not tumble within said wash chamber as it spins;

(d) rinsing said fabric by spraying water directly onto said fabric and recirculating water to said wash chamber by spraying said recirculating water directly onto said fabric while spinning said wash chamber at a speed to effect less than a one gravity centrifugal force on said fabric such that said fabric will tumble within said wash chamber as it spins;

(e) draining said wash chamber of said rinse water while spinning said wash chamber at a speed to effect more than a one gravity centrifugal force on said fabric such that said fabric will not tumble within said wash chamber as it spins; and (f) repeating steps (d) and (e) a predetermined number of times.

2. A method of rinsing fabric in a washer according to claim 1 wherein there are at least 6 and no more than 12 of said rinsing and draining steps.

3. A method of rinsing fabric in a washer according to claim 1 wherein each said rinsing step further comprises:

spraying water onto said fabric while spinning said chamber at a speed to effect a less than a one gravity centrifugal force on said fabric such that said fabric will tumble within said wash chamber as it spins; and recirculating said water and spraying said recirculated water onto said fabric while spinning said chamber at a speed to effect a more than a one gravity centrifugal force on said fabric such that said fabric will not tumble within said wash chamber as it spins.

4. A method of rinse fabric in a washer according to claim 1 wherein each of said recirculation cycles uses approximately one gallon of water.

5. A method of rinsing fabric in a washer according to claim 1 wherein fabric softener is mixed with said water in the last of said rinsing steps.

6. A method of rinsing fabric washed in a concentrated detergent solution in a washer having a wash chamber rotatable about a horizontal axis comprising the steps of:

(a) rinsing said fabric by adding water by spraying water directly onto said fabric and recirculating water by spraying water directly onto said fabric to and within said wash chamber while spinning said wash chamber at a speed to effect less than a one gravity centrifugal force on said fabric such that said fabric will tumble within said wash chamber as it spins;

(b) draining said wash chamber of said rinse water; and (c) repeating steps (a) and (b) a predetermined number of times.

7. A method of rinsing fabric in a washer according to claim 6 wherein there are at least 6 of said rinsing and draining steps.

8. A method of rinsing fabric in a washer according to claim 6 wherein there no more than 12 of said rinsing and draining steps.

9. A method of rinsing fabric in a washer according to claim 6 wherein each said rinsing step further comprises:

spraying water onto said fabric while spinning said chamber at a speed to effect a less than a one gravity centrifugal force on said fabric such that said fabric will tumble within said wash chamber as it spins; and recirculating said water and spraying said recirculated water on said fabric while spinning said chamber at a speed to effect a more than a one gravity centrifugal force on said fabric such that said fabric will not tumble within said wash chamber as it spins.

10. A method of rinsing fabric in a washer according to claim 6 wherein each of said recirculation cycles uses approximately one gallon of water.

11. A method of rinsing fabric in a washer according to claim 6 wherein fabric softener is mixed with said water in the last of said rinsing steps.

12. The method of claim 6 wherein said step of draining further comprises spinning said wash chamber at a speed to effect more than a one gravity centrifugal force on said fabric such that said fabric will not tumble within said wash chamber as it spins.

13. The method of rinsing fabric washed in a concentrated detergent solution in a washer having a wash chamber rotatable about a horizontal axis comprising the steps of:

rinsing said fabric by adding water by spraying water directly onto said fabric and recirculating water by spraying water directly onto said fabric to and within said wash chamber while spinning said wash chamber at a speed to effect less than a one gravity centrifugal force on said fabric such that said fabric will tumble within said wash chamber as it spins; and draining said wash chamber of said rinse water;

wherein there are at least 6 and no more than 12 of said rinsing and draining steps each of said rinsing steps being followed by one of said draining steps and further wherein each said rinsing step further comprises spraying approximately one gallon of said water directly onto the tumbling clothes.

14. The method of claim 13 wherein said step of draining further comprises spinning said wash chamber at a speed to effect more than a one gravity centrifugal force on said fabric such that said fabric will not tumble within said wash chamber as it spins.

15. A method of rinsing fabric washed in a concentrated detergent solution in a washer having a wash chamber rotatable about a horizontal axis comprising the steps of:

(a) spraying water directly onto said fabric while spinning said chamber at a speed to effect a less than a one gravity centrifugal force on said fabric such that said fabric will tumble within said wash chamber as it spins;

(b) recirculating said rinse water and spraying said recirculated rinse water onto said fabric while spinning said chamber at a speed to effect a more than a one gravity centrifugal force on said fabric such that said fabric will not tumble within said wash chamber as it spins;

(c) draining said wash chamber of said rinse water; and (d) repeating steps (a), (b), and (c) a predetermined number of times.

16. A method of rinsing fabric in a washer according to claim 15 wherein there are at least 6 of said rinsing, recirculating, and draining steps.

17. A method of rinsing fabric in a washer according to claim 15 wherein there are no more than 12 of said rinsing, recirculating, and draining steps.

18. A method of rinsing fabric in a washer according to claim 15 wherein each said rinsing step further comprises spraying said water directly onto the tumbling clothes.

19. A method of rinsing fabric in a washer according to claim 15 wherein each of said recirculation cycles uses approximately one gallon of water.

20. A method of rinsing fabric in a washer according to claim 15 wherein there are at least 6 and no more than 12 of said rinsing and draining steps and further wherein each said rinsing step further comprises spraying approximately one gallon of said water directly onto the tumbling clothes.

21. A method of rinsing fabric in a washer according to claim 15 wherein fabric softener is mixed with said water in the last of said rinsing steps.

22. A method of claim 15 wherein said step of draining further comprises spinning said wash chamber at a speed to effect more than a one gravity centrifugal force on said fabric such that said fabric will not tumble within said wash chamber as it spins.

* * * * *

US005233718C1

(12) EX PARTE REEXAMINATION CERTIFICATE (5924th)

United States Patent
Hardaway et al.

(10) Number: US 5,233,718 C1
(45) **Certificate Issued: *Oct. 9, 2007**

(54) TUMBLE METHOD OF RINSING FABRIC IN A HORIZONTAL AXIS WASHER

(75) Inventors: Anthony H. Hardaway, Lincoln Township, Berrien County, MI (US); Mark B. Kovich, St. Joseph Township, Berrien County, MI (US); Sheryl L. Farrington, Lincoln Township, Berrien County, MI (US); Jim J. Pastryk, Weesaw Township, Berrien County, MI (US); Jeanne C. Van Newenhizen, Benton Township, Berrien County, MI (US); John W. Euler, St. Joseph, MI (US)

(73) Assignee: Whirlpool Corporation, Benton Harbor, MI (US)

Reexamination Request:
No. 90/007,374, Jan. 11, 2005

Reexamination Certificate for:

| | |
|---|---|
| Patent No.: | **5,233,718** |
| Issued: | **Aug. 10, 1993** |
| Appl. No.: | **07/815,782** |
| Filed: | **Jan. 2, 1992** |

( * ) Notice: This patent is subject to a terminal disclaimer.

(51) Int. Cl.
*D06B 1/02* (2006.01)
*D06F 23/02* (2006.01)

(52) U.S. Cl. ..... 8/158; 8/159; 68/23.5; 68/58

(58) Field of Classification Search ..... None
See application file for complete search history.

(56) References Cited

U.S. PATENT DOCUMENTS

| | | | |
|---|---|---|---|
| 1,631,266 | A | 6/1927 | Hasha |
| 2,023,013 | A | 12/1935 | Faber et al. |
| 2,165,884 | A | 7/1939 | Chamberlin et al. |
| 2,277,923 | A | 3/1942 | Morgenstern |
| 2,291,088 | A | 7/1942 | Morgenstern |

(Continued)

FOREIGN PATENT DOCUMENTS

| | | |
|---|---|---|
| AT | 315 792 | 6/1974 |
| AT | 40 425 B | 5/1983 |
| AU | 209436 | 2/1956 |
| AU | 4147789 | 5/1990 |
| AU | 8158591 | 10/1991 |

(Continued)

OTHER PUBLICATIONS

Prosecution History of EP 0551006 (Application No. 92311796.4), "Tumbling Method of Washing Fabric in a Horizontal Axis Washer," Sep. 4, 1996 (Bates Nos. WHR 00700–00841).

(Continued)

*Primary Examiner*—Dwayne C. Jones

(57) ABSTRACT

The present invention contemplates a rinse process which can be used with any wash cycle, but which has particular utility following a wash cycle have a highly concentrated detergent solution.

The method of rinsing fabric provided by the present invention is useful in a washer having a wash chamber rotatable about a horizontal axis. The steps undertaken in the method begin with loading fabric to be washed into the wash chamber of the washer. The fabric is then washed in a detergent solution while rotating the wash chamber about its horizontal axis for a first period of time. Next the detergent solution is drained from the wash chamber. The fabric is then rinsed by adding water to the wash chamber while spinning the wash chamber at a speed to effect less than a one gravity centrifugal force on the fabric such that the fabric will tumble within the wash chamber as it spins. Finally, the wash chamber is drained of the rinse water.

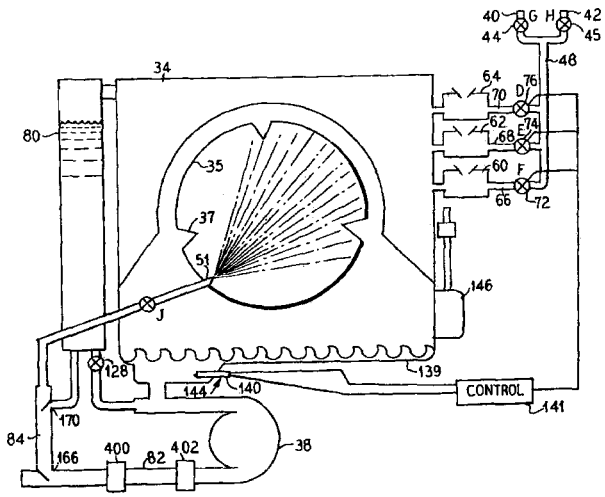

U.S. PATENT DOCUMENTS

| | | | |
|---|---|---|---|
| 2,305,154 | A | 12/1942 | Gilbert |
| 2,357,909 | A | 9/1944 | Ridge |
| 2,432,766 | A | 12/1947 | Kirby |
| 2,556,490 | A | 6/1951 | Chamberlin |
| 2,588,535 | A | 3/1952 | Kahn |
| D172,386 | S | 6/1954 | Geldhof |
| D172,387 | S | 6/1954 | Geldhof |
| D172,404 | S | 6/1954 | Sundberg |
| D174,256 | S | 3/1955 | Geldhof |
| 2,793,518 | A | 5/1957 | Geldhof |
| 2,816,427 | A | 12/1957 | Vela |
| D182,005 | S | 1/1958 | Sundberg |
| 2,833,137 | A | 5/1958 | Geldhof |
| 2,834,121 | A | 5/1958 | Geldhof |
| 2,843,943 | A | 7/1958 | Geldhof et al. |
| 2,864,249 | A | 12/1958 | Nichols |
| 2,864,250 | A | 12/1958 | Nichols |
| 2,874,762 | A | 2/1959 | Dunstan |
| 2,871,688 | A | 3/1959 | Geldhof |
| 2,883,843 | A | 4/1959 | Bochan |
| 2,895,320 | A | 7/1959 | Long |
| 2,914,935 | A | 12/1959 | Sampsel |
| 2,915,888 | A | 12/1959 | Rickel |
| 2,941,389 | A | 6/1960 | Morrison |
| 2,942,447 | A | 6/1960 | Rickel et al. |
| 2,961,863 | A | 11/1960 | Sulcek |
| 2,966,052 | A | 12/1960 | Syles |
| 2,975,623 | A | 3/1961 | Eichhorn et al. |
| 2,976,710 | A | 3/1961 | Sisson et al. |
| 2,983,314 | A | 5/1961 | Geldhof et al. |
| 3,055,202 | A | 9/1962 | Hughes |
| 3,060,713 | A | 10/1962 | Burkall |
| 3,078,700 | A | 2/1963 | Billings et al. |
| 3,080,059 | A | 3/1963 | Scott et al. |
| 3,080,252 | A | 3/1963 | Freier et al. |
| 3,086,379 | A | 4/1963 | Plante |
| 3,093,842 | A | 6/1963 | Buss |
| 3,114,919 | A | 12/1963 | Kenreich |
| 3,116,243 | A | 12/1963 | Khan et al. |
| 3,119,773 | A | 1/1964 | Compans |
| 3,135,688 | A | 6/1964 | Compans et al. |
| 3,139,633 | A | 7/1964 | Fecho et al. |
| 3,142,641 | A | 7/1964 | Lachat |
| 3,148,144 | A | 9/1964 | Brenner et al. |
| 3,151,066 | A | 9/1964 | Brenner et al. |
| 3,151,067 | A | 9/1964 | Ishoy et al. |
| 3,172,277 | A | 3/1965 | Burkland |
| 3,190,447 | A | 6/1965 | Scott |
| 3,194,398 | A | 7/1965 | Fecho |
| 3,197,979 | A | 8/1965 | Phillips et al. |
| 3,197,980 | A | 8/1965 | Marple |
| 3,204,831 | A | 9/1965 | Butler et al. |
| 3,214,665 | A | 10/1965 | Billings et al. |
| 3,219,773 | A | 11/1965 | Miller et al. |
| 3,228,525 | A | 1/1966 | Evans et al. |
| 3,230,576 | A | 1/1966 | Sauer |
| 3,231,909 | A | 2/1966 | Candor |
| 3,232,433 | A | 2/1966 | Cobb et al. |
| 3,233,434 | A | 2/1966 | Sauer |
| 3,234,449 | A | 2/1966 | Lang et al. |
| 3,235,082 | A | 2/1966 | Compans |
| 3,236,386 | A | 2/1966 | Salisbury et al. |
| 3,238,750 | A | 3/1966 | Candor et al. |
| 3,240,345 | A | 3/1966 | Butler et al. |
| 3,252,579 | A | 5/1966 | Johnson et al. |
| 3,257,736 | A | 6/1966 | Lachat et al. |
| 3,258,124 | A | 6/1966 | Cobb et al. |
| 3,262,569 | A | 7/1966 | Wade et al. |
| 3,275,146 | A | 9/1966 | Severance et al. |
| 3,283,547 | A | 11/1966 | Severance |
| 3,293,889 | A | 12/1966 | Cobb et al. |
| 3,302,433 | A | 2/1967 | Nallinger |
| 3,303,675 | A | 2/1967 | Severance et al. |
| 3,306,453 | A | 2/1967 | Khan |
| 3,307,424 | A | 3/1967 | Mandarino et al. |
| 3,312,234 | A | 4/1967 | Morey |
| 3,314,254 | A | 4/1967 | Mandarino, Jr. et al. |
| 3,314,255 | A | 4/1967 | Neumann et al. |
| 3,322,278 | A | 5/1967 | Ishoy et al. |
| 3,330,136 | A | 7/1967 | Candor et al. |
| 3,334,340 | A | 8/1967 | McConnell |
| 3,335,864 | A | 8/1967 | Miller |
| 3,344,447 | A | 10/1967 | Candor et al. |
| 3,358,301 | A | 12/1967 | Candor et al. |
| 3,358,302 | A | 12/1967 | Candor |
| 3,359,578 | A | 12/1967 | Morey et al. |
| 3,387,310 | A | 6/1968 | Marshall |
| 3,387,385 | A | 6/1968 | Mandarino, Jr. et al. |
| 3,388,410 | A | 6/1968 | Marshall |
| 3,416,334 | A | 12/1968 | Candor et al. |
| 3,446,043 | A | 5/1969 | Severance |
| 3,478,373 | A | 11/1969 | McBride et al. |
| 3,478,374 | A | 11/1969 | McBride et al. |
| 3,510,957 | A | 5/1970 | Jarvis |
| 3,524,263 | A | 8/1970 | Odle, Jr. et al. |
| 3,526,105 | A | 9/1970 | Anthony |
| 3,550,170 | A | 12/1970 | Davis |
| 3,550,171 | A | 12/1970 | Anthony et al. |
| 3,557,579 | A | 1/1971 | Marshall |
| 3,575,193 | A | 4/1971 | Niewyk et al. |
| 3,604,220 | A | 9/1971 | Taylor |
| 3,611,759 | A | 10/1971 | Janke |
| 3,616,472 | A | 11/1971 | Ripsco et al. |
| 3,648,487 | A | 3/1972 | Hoffman |
| 3,650,673 | A | 3/1972 | Ehner |
| 3,673,824 | A | 7/1972 | Ripsco et al. |
| 3,674,419 | A | 7/1972 | Tichy |
| 3,707,856 | A | 1/1973 | Niewyk et al. |
| 3,811,300 | A | 5/1974 | Barton et al. |
| 3,892,933 | A | 7/1975 | Rocchitelli |
| 3,957,661 | A | 5/1976 | Vérité |
| 3,997,292 | A | 12/1976 | Lutes et al. |
| 4,000,968 | A | 1/1977 | Schrage et al. |
| 4,118,189 | A | 10/1978 | Reinwald et al. |
| 4,128,145 | A | 12/1978 | Euler |
| 4,188,807 | A | 2/1980 | Graf et al. |
| 4,211,619 | A | 7/1980 | Usbeck |
| 4,303,406 | A | 12/1981 | Ross |
| 4,344,198 | A | 8/1982 | Arendt et al. |
| 4,432,111 | A | 2/1984 | Hoffmann et al. |
| 4,485,645 | A | 12/1984 | Mulder et al. |
| 4,489,455 | A | 12/1984 | Spendel |
| 4,489,574 | A | 12/1984 | Spendel |
| 4,580,421 | A | 4/1986 | Babuin et al. |
| 4,623,812 | A | 11/1986 | van de Griend |
| 4,631,771 | A | 12/1986 | Anderson et al. |
| 4,637,231 | A | 1/1987 | McMillan et al. |
| 4,696,171 | A | 9/1987 | Babuin |
| 4,697,293 | A | 10/1987 | Knoop |
| 4,711,103 | A | 12/1987 | Mori et al. |
| 4,784,666 | A | 11/1988 | Brenner et al. |
| 4,791,691 | A | 12/1988 | Fukuzawa et al. |
| 4,794,661 | A | 1/1989 | Durazzani |
| 4,800,035 | A | 1/1989 | Broze et al. |
| 4,916,768 | A | 4/1990 | Broadbent |
| 4,941,333 | A | 7/1990 | Blessing |
| 4,949,557 | A | 8/1990 | Price |
| 4,986,093 | A | 1/1991 | Pastryk et al. |

| | | | |
|---|---|---|---|
| 4,987,627 | A | 1/1991 | Cur et al. |
| 5,031,427 | A | 7/1991 | Pastryk et al. |
| 5,038,586 | A | 8/1991 | Nukaga et al. |
| 5,040,285 | A | 8/1991 | Williams et al. |
| 5,150,588 | A | 9/1992 | Singh et al. |
| 5,167,722 | A | 12/1992 | Pastryk et al. |
| 5,191,667 | A | 3/1993 | Roy et al. |
| 5,191,668 | A | 3/1993 | Euler et al. |
| 5,191,669 | A | 3/1993 | Euler et al. |
| 5,195,203 | A | 3/1993 | Blom et al. |
| 5,199,127 | A | 4/1993 | Van Newenhizen et al. |
| 5,219,370 | A | 6/1993 | Farrington et al. |
| 5,231,857 | A | 8/1993 | Rew et al. |
| 5,233,718 | A | 8/1993 | Hardaway et al. |
| 5,271,251 | A | 12/1993 | Kovich et al. |
| 5,327,603 | A | 7/1994 | Roh et al. |

FOREIGN PATENT DOCUMENTS

| | | | |
|---|---|---|---|
| DE | 1410985 | | 11/1968 |
| DE | 1588283 | A | 5/1970 |
| DE | 7025698 | | 12/1971 |
| DE | 3501760 | A1 | 7/1986 |
| DE | 3627732 | A | 2/1988 |
| DE | 36 33 441 | A1 | 4/1988 |
| DE | 259 317 | A3 | 8/1988 |
| DE | 3738388 | A1 | 5/1989 |
| DE | 3803616 | A1 | 8/1989 |
| DE | 39 15 345 | A1 | 12/1989 |
| DE | 39 09 021 | A1 | 9/1990 |
| DE | 32 80 450 | T2 | 8/1994 |
| EP | 0 043 122 | A1 | 1/1982 |
| EP | 0 079 234 | B1 | 5/1983 |
| EP | 0 146 719 | | 7/1985 |
| EP | 0201125 | A2 | 12/1986 |
| EP | 0222264 | A | 5/1987 |
| EP | 0238112 | A2 | 9/1987 |
| EP | 0 242 737 | | 10/1987 |
| EP | 0 244 365 | | 11/1987 |
| EP | 0 247 421 | | 12/1987 |
| EP | 0293984 | | 12/1988 |
| EP | 0318109 | A1 | 5/1989 |
| EP | 0318120 | A1 | 5/1989 |
| EP | 0319081 | A1 | 6/1989 |
| EP | 0320061 | A2 | 6/1989 |
| EP | 0335452 | A1 | 10/1989 |
| EP | 0390343 | A2 | 10/1990 |
| EP | 0404253 | A1 | 12/1990 |
| FR | 1 031 756 | | 6/1953 |
| FR | 2456802 | A | 12/1980 |
| FR | 2 525 645 | | 10/1983 |
| GB | 475197 | | 11/1937 |
| GB | 608 250 | | 9/1948 |
| GB | 761 989 | | 11/1956 |
| GB | 775 246 | | 5/1957 |
| GB | 819 251 | | 9/1959 |
| GB | 1 443 860 | | 7/1976 |
| GB | 2 011 482 | A | 7/1979 |
| GB | 2051883 | A | 1/1981 |
| GB | 2070648 | A | 9/1981 |
| GB | 2081751 | A | 2/1982 |
| GB | 2 205 585 | A | 12/1988 |
| GB | 2 219 603 | A | 12/1989 |
| IT | 1193720 | | 8/1988 |
| JP | 59118195 | | 7/1984 |
| JP | 59120197 | | 7/1984 |
| JP | 64-20895 | | 1/1989 |
| JP | UM 2-130580 | | 10/1990 |
| NL | 8002739 | A | 11/1980 |
| WO | WO 85/03729 | | 8/1985 |

OTHER PUBLICATIONS

Documents from the Prosecution History of Canadian Patent No. 2,086,151, "Tumble Method of Rinsing Fabric in a Horizontal Axis Washer," Nov. 2, 1999 (Bates Nos. WHR 00920–00979).

Documents from the Prosecution History of Indian Patent No. 185,936, "A Method of Treating the Soiled Fabrics," Jan. 1, 1993 (Bates Nos. WHR 01054–01101).

Documents from the Prosecution History of Indian Patent No. 184,950, "A Method of Treating Soiled Fabric," Dec. 30, 1992 (Bates Nos. WHR 01102–01160).

Lebot et al., "Horizontal Axis Domestic Clothes Washers: An Alternative Technology That Can Reduce Residential Energy and Water Use", *Proceedings of ACEEE 1990 Summer Study on Energy Efficiency in Buildings,* American Council for an Energy–Efficient Economy, vol. 1, pp. 1.147–1.156, 1990 (Bates Nos. LG 013595–013606).

Westinghouse—Advertisement: "Exclusive Westinghouse Multi–Speed Tumble–Action Washing Gets Clothes Clean With Only Half the Detergent and Other Washing Aids," 1974 (Bates Nos. LG 06026–06028).

Better Homes and Gardens—Advertisement: "Why RCA Whirlpool washer–dryers stand alone," undated (Bates Nos. LG 06029–06030).

Kenmore—Advertisement: "Now . . . step into the future —" (Bates Nos. LG 06031–06032).

Kenmore—Advertisement: "Now . . . step into the future —" (Bates Nos. LG 06033–06034).

Kenmore—Advertisement: "Just set it once . . . it washes," Fall/Winter 1955 (Bates Nos. LG 06035–06036).

Kenmore—Advertisement: "The Turbo–Matic," Fall/Winter 1956 (Bates Nos. LG 06037–06038).

Kenmore—Advertisement: "Wash and dry in one unit . . . ," Fall/Winter 1957 (Bates No. LG 06039).

Kenmore—Advertisement: "New Third Cycle for Wash 'n' Wear Fabrics," Winter 1958 (Bates No. LG 06040).

Kenmore—Advertisement: "All by itself," undated (Bates Nos. LG 06041–06042).

Advertisement: "Load it, set it . . . and walk away from washday work," Spring 1962 (Bates No. LG 06043–06044).

Kenmore—Advertisement: "Automatic Washers for Families with Special Needs," Spring/Summer 1970 (Bates No. LG 06045).

Kenmore—Advertisement: "Combination Washer–Dryers," Fall/Winter 1968 (Bates No. LG 06046).

Kenmore—Advertisement: "2–in–1 Washer–Dryer Combination," undated (Bates No. LG 06047).

Kenmore—Advertisement: "Lady Kenmore Laundry Appliances," Spring/Fall 1970 (Bates No. LG 06048).

Appliance Manufacturer, "Appliance Manufacturer Notes," Jan. 1953, vol. 1, No. 1, p. 54 (Bates Nos. LG 06049–06051).

Appliance Manufacturer, Advertisement, Mar. 1953, vol. 1, No. 3, pp. 5, 34 (Bates Nos. LG 06052–06054).

Appliance Manufacturer, "The Bendix Gas Duomatic," Apr. 1954, vol. 2, No. 4, pp. 5, 26 (Bates Nos. LG 06055–06058).

Appliance Manufacturer, "News in Pictures," Jun. 1954, vol. 2, No. 6, p. 5 (Bates Nos. LG 06059–06061).

Appliance Manufacturer, Advertisements, Nov. 1954, vol. 2, No. 11, pp. 5, 22, 54 (Bates Nos. LG 06062–06065).

Appliance Manufacturer, "What's New in Appliances," Dec. 1954, vol. 2, No. 12, pp. 5, 61 (Bates Nos. LG 06066–06068).

Appliance Manufacturer, "What's New in Appliances," May 1955, vol. 3, No. 5, pp. 5, 89 (Bates Nos. LG 06069–06071).
Appliance Manufacturer, "What's New in Major Appliances," Aug. 1955, vol. 3, No. 8, pp. 5, 47 (Bates Nos. LG 06072–06074).
Appliance Manufacturer, "Westinghouse Wash 'N' Dry Laundromat," Feb. 1956, vol. 4, No. 2, pp. 5, 44–45, 47–48 (Bates Nos. 06075–06080).
Appliance Manufacturer, "Westinghouse Space Mates," Jun. 1956, vol. 4, No. 6, pp. 5, 54–57 (Bates Nos. LG 06081–06086).
Appliance Manufacturer, "Home Laundries for Fifty–Seven," Sep. 1956, vol. 4, No. 9, pp. 5, 44–46 (Bates Nos. LG 06087–06091).
Appliance Manufacturer, "Washer–Dryer Combination," Jan. 1957, vol. 5, No. 1, pp. 5, 59 (Bates Nos. LG 06092–06094).
Appliance Manufacturer, Feb. 1958, vol. 6, No. 2 (Bates Nos. LG 06095–06097).
Appliance Manufacturer, "Firm Faith and the Combomatic," Apr. 1958, vol. 6, No. 4, pp. 5, 41–43 (Bates Nos. LG 06098–06102).
Appliance Manufacturer, "What's New in Appliances," Oct. 1958, vol. 6, No. 10, pp. 5, 88–89 (Bates Nos. LG 06103–06106).
Appliance Manufacturer, "A Big Move in Washer–Dryers," Dec. 1958, vol. 6, No. 12, pp. 5, 35–38 (Bates Nos. LG 06107–06112).
Appliance Manufacturer, "The L–1000 Westinghouse Laundromat," Jan. 1959, vol. 7, No. 1, pp. 5, 47, 49–51 (Bates Nos. LG 06113–06118).
Appliance Manufacturer, Aug. 1959, vol. 7, No. 8, pp. 5 (Bates Nos. LG 06119–06121).
Appliance Manufacturer, Jan. 1960, vol. 8, No. 1, pp. 5, 45 (Bates Nos. LG 06122–06124).
Appliance Manufacturer, Advertisement, May 1960, vol. 8, No. 5, pp. 5, 36 (Bates Nos. LG 06125–06127).
Appliance Manufacturer, "What's New in Appliances," Dec. 1960, vol. 8, No. 12, pp. 5, 100 (Bates Nos. LG 06128–06130).
Appliance Manufacturer, Aug. 1962, vol. 10, No. 8, pp. 5, 67 (Bates Nos. LG 06131–06133).
Appliance Manufacturer, "Connorsville—Appliance Headquarters," Jun. 1964, vol. 12, No. 6, pp. 5, 59–62 (Bates Nos. LG 06134–06139).
Appliance Manufacturer, "The Italian Appliance Market," Feb. 1965, vol. 13, No. 2, pp. 7, 45, 47–48, 73 (Bates Nos. LG 06140–06146).
Appliance Manufacturer, "The English Appliance Market," Apr. 1965, vol. 13, No. 4, pp. 5, 91–92, 94 (Bates Nos. LG 06147–06151).
Appliance Manufacturer, "Whirlpool Thinks the World of This Washer," Nov. 1990, vol. 38, No. 11, pp. 3–4, 32–33, 35, 37 (Bates Nos. LG 06152–06158).
Zanussi, "Free–Standing and Built–In Household Appliances", Domotechnica 1990, (Bates Nos. LG 06181–06205), Zanussi product brochure.
Zanussi: Washing Machine ZJ 1217, Instruction Booklet, undated (Bates Nos. LG 06206–06236).
Instructions for the Use and Care of Zanussi Washer Dryer, Model No's ZWD 1013/ZWD 1015, pp. 1–34 (Bates Nos. LG 013624–013658), ZANUSSI Ltd.
Instructions for the Use and Care of Zanussi Washing Machine, Model No. ZFL 1011, p. 1–31 (Bates Nos. LG 013659–013690), ZANUSSI Ltd.
Instructions for the Use and Care of Zanussi Washing Machine, Model No. FJ 1023/A, pp. 1–30 (Bates Nos. LG 013691–013721), Zanussi Ltd.
Instructions for the Use and Care of Zanussi Washing Machine, Model No. FJ 1011/A, pp. 1–31 (Bates Nos. LG 013722–013753), ZANUSSI Ltd.
Easy Combination Washer–Dryer, Service Forum Guide, 1957 (Bates Nos. LG 06624–06691).
Benjamins Washer Shop, The Bendix Home Laundry/Service Instructions, undated (Bates Nos. LG 06692–06787).
Westinghouse Laundromat, Service Manual, "Clothes Washer," Nov. 1955 (Bates Nos. LG 06788–06826).
Service Pointers—RCA–Whirlpool Laundry Products, Apr. 1, 1959 (Bates Nos. LG 07068–07173).
Advertisement for RCA–Whirlpool, Washer–Dryer, undated (Bates No. LG 09043).
Service Manual—Electrolux Distriparts, May 2, 2002 (Bates Nos. LG 013754–031871).
Consumer Reports, "Washing Machines," Aug. 1992, vol. 57, No. 8, pp. 478, 537–541 (Bates Nos. LG 031454–031460).
Consumer Reports, "Automatic Clothes Dryers," Jul. 1957, vol. 22, No. 7, pp. 306–314 (Bates Nos. LG 031515–031524).
Consumer Reports, "Best Buy Gifts for Christmas 1957," Nov. 1957, vol. 22, No. 11, p. 503 (Bates Nos. LG 031525–031529).
Consumer Reports, "Automatic Clothes Dryers," Feb. 1958, vol. 23, No. 2, pp. 78–80 (Bates Nos. LG 031530–035135).
Consumer Reports, "Automatic Washing Machines," Aug. 1958, vol. 23, No. 8, pp. 394, 402–410 (Bates Nos. LG 031536–031547).
Consumer Reports, Buying Guide Issue 1958, "Automatic Clothes Dryers," Dec. 1957, vol. 22, No. 12, pp. 90–97, 348–352 (Bates Nos. LG 031548–031561).
Consumer Reports, Summary–Index 1958, pp. 497, 706 (Bates Nos. LG 031562–031564).
Consumer Reports, "Automatic Washing Machines," Feb. 1959, vol. 24, No. 2, pp. 50–51, 56–59 (Bates Nos. LG 031565–031571).
Consumer Reports, "Washer–Dryer Combinations," May 1960, vol. 25, No. 5, pp. 233–239 (Bates Nos. LG 031572–031581).
Consumer Reports, "Automatic Washing Machines," Aug. 1960, vol. 25, No. 8, pp. 412–420 (Bates Nos. LG 031582–031593).
Consumer Reports, "'Best Buy' Gifts for Christmas 1960," Nov. 1960, vol. 25, No. 11, pp. 608, 610 (Bates Nos. LG 031594–031598).
Buying Guide Issue, "Washer–Dryer Combinations," pp. 170–174 (Bates Nos. LG 031599–031604).
Buying Guide Issue, "Automatic Washing Machines," pp. 175–183 (Bates Nos. LG 031605–031616).
Consumer Reports, "Life and Hard Times of the Automatic Washing Machine," Oct. 1961, vol. 26, No. 10, pp. 568–573 (Bates Nos. LG 031617–031625).
Consumer Reports, Buying Guide, "Your Home," Dec. 1961, vol. 26, No. 12, pp. 187–192 (Bates Nos. LG 031626–031633).
Consumer Reports, "Reader Reports," Apr. 1962, p. 213 (Bates Nos. LG 031634–031636).

Consumer Reports, "Washing Machines," Aug. 1962, vol. 27, No. 8, pp. 379–385 (Bates Nos. LG 031637–031646).
Consumer Reports, "Automatic Washing Machines," May 1967, vol. 32, No. 5, pp. 248–255 (Bates Nos. LG 031647–031657).
Consumer Reports, "A Combination Washer and Dryer," Jan. 1971, vol. 36, No. 1, pp. 5–7 (Bates Nos. LG 031658–031663).
Advertisement: Sears, Roebuck and Co., "The Turbo–Matic," undated (Bates Nos. LG 031664–031666).
Advertisement: Sears, Roebuck and Co., "New for 1958 . . . Kenmore 2–in–1 Turbo–Matics," undated, pp. 910–911 (Bates Nos. LG 031667–031669).
Advertisement: Sears, Roebuck and Co., "Kenmore 10–pound 2–in–1 Combinations," Fall and Winter 1958, pp. 1054–1055 (Bates Nos. LG 031670–031672).
Advertisement: Sears, Roebuck and Co., "Now . . . step into the future—," Spring and Summer 1959, pp. 912–913 (Bates Nos. LG 031673–031675).
Advertisement: Sears, Roebuck and Co., "Just set it once . . . ," pp. 1108–1109 (Bates Nos. LG 031676–031678).
Advertisement: Sears, Roebuck and Co., "Now . . . step into a future without 'Blue Mondays'," Spring through Summer 1960, p. 866 (Bates Nos. LG 031679–031681).
Advertisement: Sears, Roebuck and Co., "8–cycle Kenmore . . . ," Spring through Summer 1962, pp. 1240–1241 (Bates Nos. LG 031682–031685).
Advertisements: Sears, Roebuck and Co., Fall and Winter 1963, p. 1329 (Bates Nos. LG 031686–031687).
Advertisement: Sears, Roebuck and Co., "Lady Kenmore 2–in–1 Washer–Dryer Combination," Fall and Winter 1966, p. 1313 (Bates Nos. LG 031688–031689).
Advertisement: Sears, Roebuck and Co., "Lady Kenmore 2–in–1 Washer–Dryer Combination," Spring through Summer 1967, p. 1223 (Bates Nos. LG 031690–031691).
Advertisement: Sears, Roebuck and Co., "Lady Kenmore Combination," Fall and Winter 1967, p. 1328 (Bates Nos. LG 031692–031693).
Advertisement: Sears, Roebuck and Co., "Kenmore Combination Washer–Dryers," Spring through Summer 1968, p. 1264 (Bates Nos. LG 031694–031695).
Advertisement: Sears, Roebuck and Co., "Combination Washer–Dryers . . . ," Fall and Winter 1968, p. 1271 (Bates Nos. LG 031696–031697).
Advertisement: Sears, Roebuck and Co., "Combination Washer–Dryers," Spring through Summer 1969, p. 819 (Bates Nos. LG 031698–031699).
Advertisement: Sears, Roebuck and Co., "Kenmore Combination Washer–Dryers," Fall and Winter 1969, p. 945 (Bates Nos. LG 031700–031701).
Advertisement: Sears, Roebuck and Co., "with totally automatic convenience," Spring through Summer 1970, p. 1065 (Bates Nos. LG 031702–031703).
Advertisement: Sears, Roebuck and Co., "The Kenmore Wash 'N' Dryer Shop," Fall and Winter 1970, p. 998 (Bates Nos. LG 031704–031705).
Advertisement: Sears, Roebuck and Co., "Kenmore Wash 'N' Dryers," Spring through Summer 1971, p. 991 (Bates Nos. LG 031706–031707).
Advertisement: Sears, Roebuck and Co., "The Lady Kenmore Wash 'N' Dryer," Fall and Winter 1971, p. 1217 (Bates Nos. LG 031708–031709).
Advertisements: Sears, Roebuck and Co., Spring and Summer 1955 (Bates Nos. LG 031710–031711).
Advertisements: Sears, Roebuck and Co. (Bates Nos. LG 031712–031713).
Advertisements: Sears, Roebuck and Co., Spring and Summer 1956 (Bates Nos. LG 031714–031716).
Advertisements: Sears, Roebuck and Co., "Kenmore 'Doo–Fresh' SOAPthetic" (Bates Nos. LG 031717–031719).
Advertisements: Sears, Roebuck and Co., Spring and Summer 1957 (Bates Nos. LG 031720–031721).
Advertisements: Sears, Roebuck and Co. (Bates Nos. LG 031722–031723).
Advertisements: Sears, Roebuck and Co. (Bates Nos. LG 031724–031725).
Advertisements: Sears, Roebuck and Co., p. 1143 (Bates Nos. LG 031726–031727).
Advertisements: Sears, Roebuck and Co., Spring and Summer 1959, p. 991 (Bates Nos. LG 031728–031729).
Advertisements: Sears, Roebuck and Co., p. 1205 (Bates Nos. LG 031730–031731).
Advertisements: Sears, Roebuck and Co., Spring through Summer 1960 (Bates Nos. LG 031732–031733).
Advertisements: Sears, Roebuck and Co., Fall and Winter 1960, p. 1212 (Bates Nos. LG 031734–031735).
Advertisements: Sears, Roebuck and Co., Spring through Summer 1961, p. 1092 (Bates Nos. LG 031736–031737).
Advertisements: Sears, Roebuck and Co., Fall and Winter 1961, p. 1149 (Bates Nos. LG 031738–031739).
Advertisements: Sears, Roebuck and Co., Spring through Summer 1962, p. 1187 (Bates Nos. LG 031740–031741).
Advertisement: Sears, Roebuck and Co., "Kenmore Laundry Detergents . . . ," p. 1163 (Bates Nos. LG 031742–031743).
Advertisement: Sears, Roebuck and Co., "Kenmore Detergents Save You Money," Spring through Summer 1963, p. 1202 (Bates Nos. LG 031744–031745).
Advertisement: Sears, Roebuck and Co., "Kenmore Detergents with KE103 Whitens and Brightens Your Clothes," Fall and Winter 1963, p. 1282 (Bates Nos. LG 031746–031747).
Advertisements: Sears, Roebuck and Co., Spring through Summer 1964, p. 1334 (Bates Nos. LG 031748–031749).
Advertisements: Sears, Roebuck and Co., Fall and Winter 1964, p. 1366 (Bates Nos. LG 031750–031751).
Advertisements: Sears, Roebuck and Co., Spring through Summer 1965, p. 1238 (Bates Nos. LG 031752–031753).
Advertisements: Sears, Roebuck and Co., Fall and Winter 1965, p. 1361 (Bates Nos. LG 031754–031755).
Advertisements: Sears, Roebuck and Co., Spring through Summer 1966, p. 1217 (Bates Nos. LG 031756–031757).
Advertisements: Sears, Roebuck and Co., Fall and Winter 1966, p. 1263 (Bates Nos. LG 031758–031759).
Advertisements: Sears, Roebuck and Co., Spring through Summer 1967, p. 1187 (Bates Nos. LG 031760–031761).
Advertisements: Sears, Roebuck and Co., Fall and Winter 1967, p. 1293 (Bates Nos. LG 031762–031763).
Advertisements: Sears, Roebuck and Co., Spring through Summer 1968, p. 1211 (Bates Nos. LG 031764–031765).
Advertisements: Sears, Roebuck and Co., Fall and Winter 1968, p. 1137 (Bates Nos. LG 031766–031767).
Advertisements: Sears, Roebuck and Co., Spring through Summer 1969, p. 1170 (Bates Nos. LG 031768–031769).
Advertisements: Sears, Roebuck and Co., Fall and Winter 1969, p. 1263 (Bates Nos. LG 031770–031771).
Advertisements: Sears, Roebuck and Co., Spring through Summer 1970, p. 1222 (Bates Nos. LG 031772–031773).

Advertisements: Sears, Roebuck and Co., Fall and Winter 1970, p. 1257 (Bates Nos. LG 031774–031775).
Advertisement: Sears, Roebuck and Co., "Sears Phosphate–Free Laundry Detergent," Spring through Summer 1971, p. 961 (Bates Nos. LG 031776–031777).
Advertisement: Sears, Roebuck and Co., "Sears Laundry Detergent . . . ," Fall and Winter 1971, p. 1227 (Bates Nos. LG 031778–031779).
Advertisements: Sears, Roebuck and Co., "Sears Phosphate–Free Laundry Detergent," Spring through Summer 1972, p. 1074 (Bates Nos. LG 031780–031781).
Advertisements: Sears, Roebuck and Co, Fall and Winter 1972, p. 1047 (Bates Nos. LG 031782–031783).
Advertisements: Sears, Roebuck and Co., Spring through Summer 1973, p. 999 (Bates Nos. LG 031784–031786).
Advertisements: Sears, Roebuck and Co., Fall and Winter 1973, p. 1200 (Bates Nos. LG 031787–031788).
Advertisements: Sears, Roebuck and Co., Spring through Summer 1974, p. 905 (Bates Nos. LG 031789–031790).
Advertisements: Sears, Roebuck and Co., Fall and Winter 1974, p. 1066 (Bates Nos. LG 031791–031792).
Advertisements: Sears, Roebuck and Co., Spring and Summer 1975, p. 922 (Bates Nos. LG 031793–031794).
Advertisements: Sears, Roebuck and Co., Fall and Winter 1975, p. 1044 (Bates Nos. LG 031795–031796).
Advertisements: Sears, Roebuck and Co., 1976, p. 981 (Bates Nos. LG 031797–031799).
Advertisements: Sears, Roebuck and Co., Fall/winter 1976, p. 1221 (Bates Nos. LG 031800–031801).
Advertisements: Sears, Roebuck and Co., Spring/Summer '77, p. 1093 (Bates Nos. LG 031802–031803).
Advertisements: Sears, Roebuck and Co., Fall/Winter 1977, p. 1961 (Bates Nos. LG 031804–031805).
Advertisements: Sears, Roebuck and Co., Spring and Summer 1978, p. 1020 (Bates Nos. LG 031806–031807).
Advertisements: Sears, Roebuck and Co., Fall and Winter 1978, p. 1216 (Bates Nos. LG 031808–031809).
Advertisements: Sears, Roebuck and Co., Fall and Winter 1979, p. 1121 (Bates Nos. LG 031810–031811).
Advertisements: Sears, Roebuck and Co., Spring/Summer 1979, p. 1126 (Bates Nos. LG 031812–031813).
Advertisements: Sears, Roebuck and Co., Spring/Summer 1980 (Bates Nos. LG 031814–031815).
Advertisements: Sears, Roebuck and Co., Fall and Winter 1980, p. 1211 (Bates Nos. LG 031816–031817).
Advertisements: Sears, Roebuck and Co., Spring/Summer 1981, p. 1057 (Bates Nos. LG 031818–031819).
Advertisements: Sears, Roebuck and Co., Fall/Winter 1981, p. 1169 (Bates Nos. LG 031820–031821).
Advertisements: Sears, Roebuck and Co., Spring/Summer 1982, p. 835 (Bates Nos. LG 031822–031823).
Advertisements: Sears, Roebuck and Co., Fall/Winter 1982, p. 1064 (Bates Nos. LG 031824–031825).
Advertisements: Sears, Roebuck and Co., Spring/Summer 1983, p. 813 (Bates Nos. LG 031826–031827).
Advertisements: Sears, Roebuck and Co., Fall/Winter 1983 (Bates Nos. LG 031828–031829).
Advertisements: Sears, Roebuck and Co., Spring/Summer 1984 (Bates Nos. LG 031830–031831).
Advertisements: Sears, Roebuck and Co., Fall/Winter 1984 (Bates Nos. LG 031832–031833).
Advertisements: Sears, Roebuck and Co., Spring/Summer 1985, p. 895 (Bates Nos. LG 031834–031835).
Advertisements: Sears, Roebuck and Co., Fall and Winter 1985, p. 1194 (Bates Nos. LG 031836–031837).
Advertisements: Sears, Roebuck and Co., 1986, p. 1064 (Bates Nos. LG 031838–031839).
Advertisements: Sears, Roebuck and Co., 1988, p. 676A (Bates Nos. LG 031840–031842).
Advertisements: Sears, Roebuck and Co., 1989, vol. 3, p. 174 (Bates Nos. LG 031843–031845).
Advertisements: Sears, 1989, p. 452 (Bates Nos. LG 031846–031847).
Advertisements: Sears, Fall 1989 (Bates Nos. LG 031848–031849).
Advertisements: Sears, Spring 1990, p. 593 (Bates Nos. LG 031850–031851).
Advertisements: Sears (Bates Nos. LG 031852–031853).
Advertisements: Sears (Bates Nos. LG 031854–031855).
Advertisements: Sears, Fall 1991, p. 598 (Bates Nos. LG 031856–031858).
Consumers' Research Bulletin, "Automatic Washing Machines and Washer–Dryer Combinations," Jan. 1957, vol. 39, No. 1, pp. 2, 5–13 (Bates Nos. LG 031859–031869).
Consumer Bulletin, "Clothes Dryers—II," Oct. 1958, vol. 41, No. 10, pp. 5, 19–22 (Bates Nos. LG 031870–031875).
Consumer Bulletin, "Clothes Dryers—I," Sep. 1958, vol. 41, No. 9, pp. 5, 6–12, 16–17 (Bates Nos. LG 031876–031886).
Consumer Bulletin, "Clothes Washer–Dryer Combinations," Mar. 1959, vol. 42, No. 3, pp. 5, 6–9, 32 (Bates Nos. LG 031887–031893).
Consumer Bulletin, "Automatic Washing Machines," May 1959, vol. 42, No. 5, pp. 5, 19–25 (Bates Nos. LG 031894–031902).
Consumer Bulletin, "Hamilton Automatic Clothes Washer," Jul. 1959, vol. 42, No. 7, pp. 2, 5 (Bates Nos. LG 031903–031905).
Consumer Bulletin, "General Electric Laundry Appliances," Apr. 1960, vol. 43, No. 4, pp. 11–12 (Bates Nos. LG 031906–031909).
Consumer Bulletin, "Toys for Christmas," Dec. 1960, vol. 43, No. 12, pp. 5, 12, 14 (Bates Nos. LG 031910–031913).
Consumer Bulletin, "Washer–dryer combinations," Aug. 1961, vol. 44, No. 8, pp. 5–10 (Bates Nos. LG 031914–031920).
Ad Detergent Commercial, 1958 (Bates No. LG 08750A) (on CD ROM).
Ad Detergent Commercial (Bates No. LG 08750B) (on CD ROM).
All Detergent Commercial, 1960s (Bates No. LG 08750C) (on CD ROM).
All Detergent Commercial, 1957 (Bates No. LG 08750D) (on CD ROM).
Cheer Detergent Commercial (Bates No. LG 08750E) (on CD ROM).
Cheer Detergent Commercial (Bates No. LG 08750F) (on CD ROM).
Dash Detergent Commercial (Bates No. LG 08750G) (on CD ROM).
Dash Detergent Commercial (Bates No. LG 08750H) (on CD ROM).
Dash Detergent Commercial (Bates No. LG 08750I) (on CD ROM).
Downy Fabric Softener Commercial (Bates No. LG 08750J) (on CD ROM).

Duz Soap Commercial (Bates No. LG 08750K) (on CD ROM).
Wisk Detergent Commercial (Bates No. LG 08750L) (on CD ROM).
Oxydol Commercial on the Beulah Show (Bates No. LG 08750M) (on CD ROM).
Salvo Commercial (Bates No. LG 08750N) (on CD ROM).
Liquid Wisk Detergent Commercial (Bates No. LG 08750O) (on CD ROM).
Liquid Wisk Detergent Commercial (Bates No. LG 08750P) (on CD ROM).
Ad Detergent Commercial (Bates No. LG 08750Q) (on CD ROM).
"Whirlpool's Responses to LG Electronics U.S.A., Inc.'s First Set of Interrogatories to Whirlpool (Nos. 1–11)," Case No. 4:03CV0113, in the United States District Court for the Western District of Michigan, Southern Division, Dec. 1, 2003.
"Defendants' Identification of Prior Art," Case No. 4:03CV0113, in the United States District Court for the Western District of Michigan, Southern Division, Dec. 29, 2003.
"Whirlpool's Reply to LG's Amended Joint Counterclaims," Case No. 4:03–CV–0113, in the United States District Court for the Western District of Michigan, Southern Division, Mar. 30, 2004.
"Whirlpool's Responses to LG's Second Set of Interrogatories to Whirlpool (Nos. 12–14)," Case No. 4:03CV0113, in the United States District Court for the Western District of Michigan, Southern Division, Aug. 23, 2004.
"Whirlpool's Supplemental Response to LG Electronics U.S.A., Inc.'s Interrogatory No. 5," Case No. 4:03CV0113, in the United States District Court for the Western District of Michigan, Southern Division, Oct. 8, 2004.
"Whirlpool's Responses to LG's Revised Second Set of Requests for Admissions to Whirlpool (Nos. 10–65)," Case No. 4:03CV0113, in the United States District Court for the Western District of Michigan, Southern Division, Oct. 13, 2004.
"Whirlpool's Responses to LG's Third Set of Requests for Admissions to Whirlpool (Nos. 66–131)," Case No. 4:03CV0113, in the United States District Court for the Western District of Michigan, Southern Division, Dec. 1, 2004.
"Whirlpool's Responses to LG's Third Set of Interrogatories to Whirlpool (Nos. 15–31)," Case No. 4:03CV0113, in the United States District Court for the Western District of Michigan, Southern Division, Dec. 1, 2004.
Transcript of Deposition of John Dietrich, taken by the Defendants and Counterplaintiffs on Feb. 25, 2005, Case No. 4:03CV0113, in the United States District Court for the Western District of Michigan, Southern Division.
Transcript of Deposition of John Pielemeier, taken by the Defendants Counterplaintiffs on Feb. 24, 2005, Case No. 4:03CV0113, in the United States District Court for the Western District of Michigan, Southern Division.
Transcript of Deposition of John W. Euler, taken by the Defendants and Counterplaintiffs on Nov. 12, 2004, Case No. 4:03CV0113, in the United States District Court for the Western District of Michigan, Southern Division.
Transcript of Deposition of Jeanne C. Van Newenhizen, taken by the Defendants on Sep. 30, 2004, Case No. 4:03CV0113, in the United States District Court for the District of Michigan, Southern Division.
Jorgensen, K., Whirlpool Laboratory Report, "Evaluation of Automatic Washer Detergent Suds Formation", Aug. 3, 1978 (Deposition Exhibit No. 1–JP (Feb. 24, 2005)) (Deposition Exhibit No. Euler 19 (Nov. 12, 2004)) (Bates Nos. WHR 37455–37456).
Photographs of Combination Washer–Dryers taken during an inspection on Feb. 25, 2004 (Deposition Exhibit No. 3–JP (Feb. 24, 2005)) (Deposition Exhibit No. Euler 19 (Nov. 12, 2004)) (Bates Nos. LG 08770–08781) [Washer Nos. 1 and 2: Model No. 110.7110910; Washer No. 3: Model No. 110.7109910; Washer No. 4: Model No. 110.5710750; Washer No. 5: Model No. 110.6909500; and Washer No. 6: Model No. 110.7110910].
RCA–Whirlpool Service Literature, Laundry Products, Washer–Dryer (Electric), Apr. 1958 (Deposition Exhibit No. 4 JP (Feb. 24, 2005)) (Deposition Exhibit No. Euler 23 (Nov. 24, 2005)) (Bates Nos. LG 06350–06376).
[Document generated during litigation by Defendants] "Operation of Whirlpool Combination Washer–Dryer Model No. W–5810503," (Deposition Exhibit No. 6 JP (Feb. 24, 2005)).
Sears Nation–Wide Service, 1963 Combination Washer–Dryer Service Manual (Deposition Exhibit No. 7 JP (Feb. 24, 2005)) (Deposition Exhibit No. Euler 24 (Nov. 12, 2004)) (Bates Nos. WHR 07086–07186).
Sears, "Kenmore Laundry Guide for Your New Washer–Dryer," undated (Deposition Exhibit No. 8 JP (Feb. 24, 2005)) (Bates Nos. LG 06503–06538).
[Document generated during litigation by Defendants] "Operation of Kenmore Combination Washer–Dryer Model No. 110.6510900W00 in the 'Super Wash' Cycle," (Deposition Exhibit No. 9 JP (Feb. 24, 2005)).
History of 29" Wash 'N Dryer in Chronological Order, Nov. 1971 (Deposition Exhibit No. 10 JP (Feb. 24, 2005)) (Bates Nos. WHR 07037–07047).
Photographs of Horizontal Axis Washers (Deposition Exhibit No. Euler 12 (Nov. 12, 2004)) (Deposition Exhibit No. 12 JP (Feb. 24, 2005)) (Bates Nos. WHR 31762–31771).
Hardaway, A., et al., Whirlpool Project Report, "Evaluation of Procter and Gamble's CDLP Horizontal Washer," Jan. 18, 1984 (Deposition Exhibit No. VN–6 (Sep. 30, 2004)) (Bates Nos. WHR 16046–16061).
Hardaway, A., et al., Whirlpool Project Report, "Concentrated Laundry Detergent Wash Cycle in the Leap Automatic Washer," Mar. 12, 1985 (Deposition Exhibit No. VN–7 (Sep. 30, 2004)) (Bates Nos. WHR 16030–16045).
Hardaway, A., et al., Whirlpool Project Report, "Concentrated Laundry Detergent Wash Cycle in the Leap Automatic Washer," Mar. 12, 1985 (Deposition Exhibit No. VN–8 (Sep. 30, 2004)) (Bates Nos. WHR 04667–04682).
Hardaway, A., et al., Whirlpool Project Report, "Rinsability Evaluation of the High Performance Wash Cycle (HPWC) and a Washability Update," May 14, 1987 (Deposition Exhibit No. VN–9 (Sep. 30, 2004)) (Bates Nos. WHR 04727–04734).
Hardaway, A., et al., Whirlpool WIN Summary, "Suds Handling in Concentrated Leap," Jul. 1, 1986 (Deposition Exhibit No. VN–10 (Sep. 30, 2004)) (Bates Nos. WHR 16023–16029).
Hardaway, A., et al., Whirlpool Project Report, "Evaluation of the G.E. Spotscrubber Cycle," Sep. 25, 1986 (Deposition Exhibit No. VN–11 (Sep. 30, 2004)) (Bates Nos. WHR 16009–16020).

Hardaway, A., et al., Whirlpool WIN Summary, "Soil Removal Evaluation of the Avanti and the General Electric Horizontal Axis Washers," Jul. 17, 1987 (Deposition Exhibit No. VN–12 (Sep. 30, 2004)) (Bates Nos. WHR 16157–16159).

Hardaway, A., et al., Whirlpool Project Report, "Evaluation of the High Performance Wash Cycle," May 1, 1987 (Deposition Exhibit No. VN–13 (Sep. 30, 2004)) (Bates Nos. WHR 16118–16145).

Hardaway, A., et al., Whirlpool WIN Summary, "Concept Feasibility Evaluation of the PSC Minitub Feature—A Washability View Point," Mar. 16, 1988 (Deposition Exhibit No. VN–14 (Sep. 30, 2004)) (Bates Nos. WHR 16021–16022).

Ciboch, Dennis, "Concentrated Wash System," Nov. 15, 1988 (Deposition Exhibit No. VN–15 (Sep. 30, 2004)) (Bates Nos. WHR 04814–04816).

Kovich, M., et al., Whirlpool Project Report, "Horizontal Axis Washer with High Performance Wash Concepts," Sep. 4, 1990 (Deposition Exhibit No. VN–17 (Sep. 30, 2004)) (Deposition Exhibit No. Euler 10 (Nov. 12, 2004)) (Bates Nos. WHR 16102–16116).

Anselmino, Mary Ann, "Perceptions of the Kenmore Horizontal Access Washing Machine," May 2, 1991 (Deposition Exhibit No. VN–18 (Sep. 30, 2004)) (Bates Nos. WHR 03212–03221).

Hardaway, A., Whirlpool WIN Summary, "Sequoia Wash & Rinse Performance Baseline," Jun. 29, 1993 (Deposition Exhibit No. VN–22 (Sep. 30, 2004)) (Bates Nos. WHR 16187–16196).

Thurlow, Sandy, "Usability Study of Horizontal Axis Washer: Summary of Apr. 25, 1991 Meeting," Apr. 25, 1991 (Deposition Exhibit No. VN–23 (Sep. 30, 2004)) (Bates Nos. WHR 03198–03203).

Gartley, W., "Horizontal Axis Washer 'NEW' Significant Activity Log," Apr. 5, 1978 (Deposition Exhibit No. 16–JD (Feb. 25, 2005)) (Bates Nos. WHR 36037–36050).

Rutkowski, B.J., Whirlpool Project Report, "The Effects of Water Level, Load Size and Load Composition on Washability in the N.E.W.," Oct. 26, 1981 (Deposition Exhibit No. 17–JD (Sep. 25, 2005)) (Bates Nos. WHR 21637–21654).

Gartley, W., "Fabric Abrasion During Laundering," Jan. 10, 1980 (Deposition Exhibit No. 18–JD (Feb. 25, 2005)) (Bates Nos. WHR 36305–36317).

Diagram from the Deposition of John Euler, taken by the Defendants and Counterplaintiffs on Nov. 12, 2004, Case No. 4:03CV0113, in the United States District Court for the Western District of Michigan, Southern Division (Deposition Exhibit No. Euler 9 (Nov. 12, 2004)).

Euler, J., "Inspection of Horizontal Axis Machines," Feb. 11, 1991 (Deposition Exhibit No. Euler 11 (Nov. 12, 2004)) (Bates No. WHR 31444).

Procter & Gamble ETC, "Washing Conditions Comparisons," (Deposition Exhibit No. Euler 13 (Nov. 12, 2004)) (Bates No. WHR 03228).

Euler, J., Whirlpool WIN Summary, "Trip Report—Visit to Bauknecht, Schorndorf, Sep. 2–6, 1991," Sep. 18, 1991 (Deposition Exhibit No. Euler 14 (Nov. 12, 2004)) (Bates Nos. WHR 21867–21868).

Diagram and first pages from U.S. Patent Nos. 5,191,669 and 5,191,668, from the Deposition of John Euler, taken by the Defendants and Counterplaintiffs on Nov. 12, 2004, Case No. 4:03CV0113, in the United States District Court for the Western District of Michigan, Southern Division (Deposition Exhibit No. Euler 15 (Nov. 12, 2004)).

"MINUTES: High Performance Wash Review with Product Managers, Nov. 8, 1988," (Deposition Exhibit No. Euler 16 (Nov. 12, 2004)) (Bates Nos. WHR 04809–04812).

Euler, J., et al., Whirlpool WIN Summary, "Performance Comparison of the High Performance (HP) LEAP, the Standard LEAP, and Horizontal Axis Machines," Nov. 10, 1988 (Deposition Exhibit No. Euler 17 (Nov. 12, 2004)) (Bates Nos. WHR 21877–21901).

Euler, J., et al., Whirlpool WIN Summary, "Performance Comparison of the High Performance (HP) LEAP, the Standard LEAP, and Horizontal Axis Machines," Jan. 6, 1989 (Deposition Exhibit No. Euler 18 Nov. 12, 2004)) (Bates Nos. WHR 21871–21876).

Euler, J., "Notes from the Discussion of Wash Systems with the WIBV Engineers on Jun. 16, 1992," Jun. 22, 1992 (Deposition Exhibit No. Euler 20 (Nov. 12, 2004)) (Bates Nos. WHR 41692–41694).

Concept Evaluation Tollgate, Mar. 23, 1993 (Deposition Exhibit No. Euler 21 (Nov. 12, 2004)) (Bates Nos. WHR 47559–47674).

[Document generated during litigation by Defendants] Diagrams (Deposition Exhibit No. Euler 22 (Nov. 12, 2004)).

Service Manual for RCA Whirlpool Washer–Dryers (Electric), Apr. 1961, pp. ii–39, Whirlpool Corporation, St. Joseph, Michigan (Bates Nos. LG 06461–06502).

"Owner's manual for your new washer–dryer," Part No. 288021, pp. 1–34, Sears, Roebuck and Co., Chicago, Illinois, 60607 (Bates Nos. LG 06539–06574).

Service Manual for RCA Whirlpol Washer–Dryers (Electric), SF–139, Apr. 1957, pp. ii–C–11, Whirlpool Corporation, St. Joseph, Michigan (Bates Nos. LG 06575–06610).

Specifications and Features, W–6110501, W–6110502, W–6110503, RCA Whirlpool Laundry Products (Bates Nos. LG 06611–06615).

Service Manual for RCA Whirlpool Washer–Dryers (Gas), SF–140, Rev. Nov. 1957, pp. ii–V–3, Whirlpool Corporation, St. Joseph, Michigan (Bates Nos. LG 08402–08447).

Service Manual for RCA Whirlpool Washer–Dryers (Electric), SF–139, Apr. 1958, pp. ii–V–4, Whirlpool Corporation, St. Joseph, Michigan (Bates Nos. LG 08448–08484).

Temporary Service Parts List for RCA Whirlpool Combination Washer–Dryer model W5710500, Part No. 99107, Dec. 1956, pp. 1–10, Whirlpool–Seeger Corporation, St. Joseph, Michigan (Bates Nos. LG 08485–08494).

Temporary Service Parts List for RCA Whirlpool Combination Washer–Dryer model W5710501, Part No. 99136, Jan. 1957, pp. 1–10, Whirlpool–Seeger Corporation, St. Joseph, Michigan (Bates Nos. LG 08495–08504).

Temporary Service Parts List for RCA Whirlpool Combination Washer–Dryer model W5710502, Part No. 99169, Mar. 1957, pp. 1–10, Whirlpool–Seeger Corporation, St. Joseph, Michigan (Bates Nos. LG 08505–08514).

Temporary Service Parts List for RCA Whirlpool Electric Combination Washer–Dryer model W5710503, Part No. 99197, Jul. 1957, pp. 1–10, Whirlpool Corporation, St. Joseph, Michigan (Bates Nos. LG 08515–08524).

Temporary Service Parts List for RCA Whirlpool Electric Combination Washer–Dryer model W5710504, Part No. 99354, Oct. 1957, pp. 1–10, Whirlpool Corporation, St. Joseph, Michigan (Bates Nos. LG 08525–08534).

Temporary Service Parts List for RCA Whirlpool Electric Combination Washer–Dryer model W5710505, Part No. 99400, Jan. 1958, pp. 1–10, Whirlpool Corporation, St. Joseph, Michigan (Bates Nos. LG 08535–08544).

Temporary Service Parts List for RCA Whirlpool Gas Combination Washer–Dryer model W5709500, Part No. 99194, May 1957, pp. 1–12, Whirlpool Corporation, St. Joseph, Michigan (Bates Nos. LG 08545–08556).

Temporary Service Parts List for RCA Whirlpool Gas Combination Washer–Dryer model W5709501, Part No. 99294, Aug. 1957, pp. 1–12, Whirlpool Corporation, St. Joseph, Michigan (Bates Nos. LG 08557–08568).

Temporary Service Parts List for RCA Whirlpool Gas Combination Washer–Dryer model W5709502, Part No. 99399, Feb. 1958, pp. 1–12, Whirlpool Corporation, St. Joseph, Michigan (Bates Nos. LG 08569–08580).

Service Parts List for RCA Whirlpool Gas Combination Washer–Dryer model W5809400 (EC–45), Part No. 99590, Aug. 1958, pp. 1–11, Whirlpool Corporation, St. Joseph, Michigan (Bates Nos. LG 08581–08591).

Service Parts List Supplement for RCA Whirlpool Gas Combination Washer–Dryer model W5809500, Part No. 99547, Jul. 1958, pp. 1–11, Whirlpool Corporation, St. Joseph, Michigan (Bates Nos. LG 08592–08602).

Service Parts List Supplement for RCA Whirlpool Gas Combination Washer–Dryer model W5809501, Part No. 99783, Dec. 1958, p. 1–3, Whirlpool Corporation, St. Joseph, Michigan (Bates Nos. LG 08603–08605).

Service Parts List Supplement for RCA Whirlpool Gas Combination Washer–Dryer model W5809502 (EC–55), Part. No. 99843, Jan. 1959, pp. 1–6, Whirlpool Corporation, St. Joseph, Michigan (Bates Nos. LG 08606–08611).

Service Parts List Supplement for RCA Whirlpool Electric Combination Washer–Dryer model W5810400 (EC–40), Part No. 99561, Jul. 1958, pp. 1–10, Whirlpool Corporation, St. Joseph, Michigan (Bates Nos. LG 08612–08621).

Service Parts List Supplement for RCA Whirlpool Electric Combination Washer–Dryer model W5810500, Part No. 99548, Jul. 1958, pp. 1–10, Whirlpool Corporation, St. Joseph, Michigan (Bates Nos. LG 08622–08631).

Service Parts List Supplement for RCA Whirlpool Electric Combination Washer–Dryer model W5810502 (EC–50), Part No. 99847, Jan. 1959, pp. 1–6, Whirlpool Corporation, St. Joseph, Michigan (Bates Nos. LG 08640–08645).

Service Parts List Supplement for RCA Whirlpool Electric Combination Washer–Dryer model W5810503 (EC–50), Part No. 99986, Jun. 1959, pp. 1–8, Whirlpool Corporation, St. Joseph, Michigan (Bates Nos. LG 08646–08653).

Parts List for RCA Whirlpool Electric Combination Washer–Dryer model W6010500 (GC–50), Part No. 89117, Dec. 1959, pp. 1–14, Whirlpool Corporation, St. Joseph, Michigan (Bates Nos. LG 08675–08687).

Stevens, J., "Upbeat at Domotechnica: The Innovations abound—water savings, noise reductions, energy savings," *Appliance,* not dated (Bates Nos. LG 034625–034628).

Simpson, D., "43$^{rd}$ Annual Laundry Report, 'Washing Smart'," *Appliance,* not dated (Bates Nos. LG 034629–034639).

"A Progress Report on Whirlpool–Seeger: 'The 1957 Models of the Full Major Appliance Line'," *Appliance Manufacturer,* Jan. 1957, vol. 5, No. 1, p. 59 and others (Bates Nos. LG 054778–054785).

Stevens, J., "Upbeat at Domotechnica," *Appliance,* Apr. 1986, 43(4):3, 39–43 (Bates Nos. LG 054786–054792).

Scharfe, T., "New Ware for Wash 'n Dry," *Appliance,* Sep. 1986, 43(9):3, 47–51 (Bates Nos. LG 054793–054799).

Simpson, D., "Meeting World Laundry Needs," *Appliance,* Sep. 1989, 46(9):3, 75–81 (Bates Nos. LG 054800–054808).

Simpson, D., "43$^{rd}$ Annual Laundry Report, 'Washing Smart'," *Appliance,* Sep. 1990, 47(9):3, 75–78 (Bates Nos. LG 054809–054814).

Somheil, T., "New Ways of Washing," *Appliance,* Sep. 1992, 49(9):3, 74–77 (Bates Nos. LG 054815–054820).

Owens, D., "Diverse Designs for an Expanding Market," *Appliance,* Sep. 1978, 35(9):3, 44–47 (Bates Nos. LG 054821–054826).

"Design of the Month—Westinghouse Wash'N'Dry Laundromat," *Appliance Manufacturer,* Feb. 1956, 4(2):5, 44, 45, 47 et seq. (Bates Nos. LG 054827–054832).

Features, Benefits and Specifications of SuperLoad II 25 lb. front loading washer/extractor, Metered models: CL9161–CL9163, Non–metered models: CL9171–CL9173, not dated, Speed Queen Co., a Raytheon Company, Ripon, WI 54971 (Bates Nos. LG 054883–054884).

Remich, N.C. Jr., "Redesigns call for recycling. (washing machines).," Trade & Industry Database 1981 to 1991 (ID91), Dec. 6, 1991 update, Accession No. 08929809 (Bates Nos. LG 054888–054891).

Simpson, D.E., "Washing smart: fuzzy logic is but one approach laundry appliances producers have taken to address consumer needs and priorities," Trade & Industry Database 1981 to 1991 (ID91), Oct. 20, 1991 update, Accession No. 09330648 (Bates Nos. LG 054891–054897).

Toor, M., "Zanussi sticks with strapline," Trade & Industry Database 1981 to 1991 (ID91), Jun. 14, 1991 update, Accession No. 09861065 (Bates Nos. LG 054897–054898).

Simpson, D.E., "Meeting world laundry needs: engineered convenience and efficiency lead the way," Trade & Industry Database 1981 to 1991 (ID91), Jun. 14, 1991 update, Accession No. 08031157 (Bates Nos. LG 054898–054906).

Ciravegna, N., "La Lunga Crisi Degli Elettro Domestici Non Ferma L'Innovazione Produttiva," Il Sole 24 Ore 1984 to date (SOLE), 1991 update, Accession No. SS860620009DAA (Bates Nos. LG 054911–054913).

Ciravegna, N., "Lavatrici, Scontro Sui Brevetti. Presentati in questi giorni due modelli (simili) da Candy e Zanussi," Il Sole 24 Ore 1984 to date (SOLE), 1991 update, Accession No. SS860228009EAA (Bates No. LG 054913).

Simpson, D.E., "Washing smart: fuzzy logic is but one approach laundry appliances producers have taken to address consumer needs and priorities," Trade & Industry Database 1981 to 1991 (ID91), Oct. 20, 1991 update, Accession No. 09330648 (Bates Nos. LG 054917–054923).

"A Natale un regalo ad alta tecnologia," Il Sole 24 Ore 1984 to date (SOLE), Dec. 23, 1992 update, Accession No. SS921218020AAA (Bates Nos. LG 054927–054929).

Barile, L., "Elettrodomestici: A Colonia (Sfonda) L'Industria Italiana" Il Sole 24 Ore 1984 to date (SOLE), 1991 update, Accession No. SS870214005LAA (Bates Nos. LG 054929–054930).

"La Zanussi Prevede Per L'86 Un Utile Di Oltre 27 Millardi. Secondo stime dell'Electrolux.", Il Sole 24 Ore 1984 to date (SOLE), 1991 update, Accession No. SS860812010CAA (Bates Nos. LG 054930–054931).

"Di Benetton E Sip L'Immagine Migliore," Il Sole 24 Ore 1984 to date (SOLE), 1991 update, Accession No. SS860307009GAA (Bates Nos. LG 054931–054932).

Ciravegna, N., "Zanussi Resping Le Accuse Candy," Il Sole 24 Ore 1984 to date (SOLE), 1991 update, Accession No. SS860301008HAA (Bates Nos. LG 054932–054933).

Ciravegna, N., "Lavatrici, Scontro Sui Brevetti. Presentati in questi giomi dur modelli (simili) da Candy e Zanussi," Il Sole 24 Ore 1984 to date (SOLE), 1991 update, Accession No. SS860228009EAA (Bates Nos. LG 054933–054934).

RT, "Gruppo Zanussi: 106 Miliardi Di Utile Nell '88," Italian General News Service (Italian), 1981 to two days ago (ANSA), Jan. 1, 1989 update, Accession No. X7VHTBZCZC2850A (Bates Nos. LG 054935–054936).

"RFG: Polemiche Su Pubblicita' Zanussi," Italian General News Service (Italian), 1981 to two days ago (ANSA), Jan. 1, 1986 update, Accession No. PMVCW6ZCZC4390A (Bates Nos. LG 054936–054938).

Rudnick, D., "Savings begin in the home," *The Times,* Jan. 15, 1990 (Bates Nos. LG 054972–054973).

"Adwatch: Clean win for Zanussi," *Marketing,* May 19, 1988 (Bates Nos. LG 054974–054975).

"New Campaigns: Zanussi reveals newcomer," *Campaign,* Oct. 10, 1986 (Bates Nos. LG 054976).

Friedman, A., "Zanussi expects return to profit as orders rise," *Financial Times* (*London, England*), Feb. 4, 1986 (Bates No. LG 054993).

True, Brian, "Laboratory Report re: ASKO Horizontal Axis Washer," Nov. 4, 1994, pp. 1–19, Whirlpool Corporation, St. Joseph, MI (Bates Nos. WHR 02611–02629).

Vannewenhizen, J. et al., "Advanced Wash Systems Project Report re: WCI Horizontal Axis: Soil Removal and Rinse Performance Comparing to Leap," Mar. 13, 1994, pp. 1–12, Whirlpool Corporation, Benton Harbor, MI (Bates Nos. WHR 02807–02829).

Vannewenhizen, J. et al., "Advanced Wash Systems Project Report re: Horizontal Comparison," Report No. TE–513740–AD, Nov. 30, 1993, pp. 1–7, Whirlpool Corporation, Benton Harbor, MI (Bates Nos. WHR 02885–02891).

Vannewenhizen, J. et al., "Advanced Wash Systems Project Report re: Horizontal Wash Method Comparison," Nov. 5, 1993, pp. 1–9, Whirlpool Corporation, Benton Harbor, MI (Bates Nos. WHR 02892–02900).

Hardaway, A., "Project Report 513740–009, 'Sequoia Wash & Rinse Performance Baseline'," Jun. 28, 1993, Whirlpool Corporation, Benton Harbor, MI (Bates Nos. WHR 02954–02961).

Sutton, T., "Project Sequoia Teardown Report—Bosch Siemens," Sep. 28, 1992, Whirlpool Corporation (Bates Nos. WHR 02978–02979).

Sutton, T., "Project Sequoia Recyclability Team re: Bosch–Siemens Teardown Report," Aug. 3, 1992, Whirlpool Corporation (Bates Nos. WHR 02982–02984).

"Gebrauchs–anweisung, Waschvollautomaten WA 9872/WA 9871 E/WA 9772 G/WA 9770 G/WA 9672/WA 9670," not dated, pp. 1–31, Bauknecht, printed in W. Germany (Bates Nos. WHR 03247–03262).

Parts List for Sears Kenmore Front Loader Washer Models 417.84988100 (White) & 417.84988800 (Almond), not dated, pp. 1–9, Sears, Roebuck and Co., Chicago, IL (Bates Nos. WHR 03264–03272).

Kenmore Front Load Washer Use and Care Guide, Series 49881, pp. 1–16, Sears (Bates Nos. WHR 03273–03289).

Hloch, H.G., "50 Years Development of Washing Machines," not dated, pp. 1–12 (Bates Nos. WHR 04549–04560).

Division 26 Advance Service Information Laundry Products, Wash N' Dryers, Automatic Washers, Wringer Washers, Div. 26, Jul. 1970, No. 1, pp. 1–9, Sears Care Protective Maintenance (Bates Nos. WHR 07048–07057).

"29" Combination Washer–Dryer History," Aug. 10, 1966 (Bates Nos. WHR 07058–07063).

"Manufacturing and Engineering Improvements to the Washer–Dryer Mar. 16, 1959–Apr. 18, 1960" (Bates Nos. WHR 07070–07072).

"Manufacturing and Engineering Improvements to the Washer–Dryer Jul. 7, 1959–Apr. 18, 1960" (Bates Nos. WHR 07073–07075).

"Serial Number and Date of All Changes on 29" Combinations Sep. 27, 1960–Apr. 14, 1961" (Bates Nos. WHR 07076–07080).

Radde, H., "Change Dates for the Combination Mar. 28, 1961–Jan. 9, 1962" (Bates Nos. WHR 07081–07085).

"Here it is! Your 1965 Combination Washer–Dryer, The Complete Laundry Appliance Joins the Famous Family of Lady Kenmore," *Current Facts for Better Selling 707, Merchandise and Sales Training,* Nov. 1, 1964, pp. 1–28, Sears (Bates Nos. WHR 07210–07239).

Division 26 Basic Service Manual Laundry Products Electrical Diagnosis Guide, Automatic Washers, Gas and Electric Dryers, Wash N' Dryers, Supplement 3, Jun. 1970, Sears (Bates Nos. WHR 07983–08054).

Division 26 Advance Service Information Laundry Products, Automatic Washer, Automatic Dryers, Combinations, Wringer Washers, Div. 26, Aug. 1967, No. 2, pp. 1–20, Sears Care Protective Maintenance (Bates Nos. WHR 08065–08084).

Division 26 Attention Service Manager, Advance Service Information, 1965 Combination Washer–Dryer 110.6509910X 5991X, Div. 26, Aug. 1965, No. 1D, Sears Nation–Wide Service, pp. 1–7 (Bates Nos. WHR 08085–08092).

"Before You Phone the Service Doctor," Part No. 288574, Sears (Bates Nos. WHR 09048–09056).

Parts List for Kenmore Gas Wash'n Dryer Model 110.7109910, 288614 Rev. A. 5–71, pp. 1–20, Sears, Roebuck and Co. (Bates Nos. WHR 09093–09112).

Service Manual for RCA Whirlpool Washer–Dryers (Electric), Apr. 1961, pp. ii–41, Whirlpool Corporation, St. Joseph, Michigan (Bates Nos. WHR 09653–09699).

Service Manual for RCA Whirlpool Washer–Dryers (Gas), SF–140, Revision 1–60, Jan. 1960, Whirlpool Corporation, St. Joseph, Michigan (Bates Nos. WHR 09700–09751).

Service Manual for RCA Whirlpool Washer–Dryers (Gas) Apr. 1961, pp. ii–50, Whirlpool Corporation, St. Joseph, Michigan (Bates Nos. WHR 09752–09806).

Service Manual for RCA Whirlpool Washer–Dryers (Electric), Apr. 1961, pp. ii–41, Whirlpool Corporation, St. Joseph, Michigan (Bates Nos. WHR 09807–09853).

Service Manual for RCA Whirlpool Washer–Dryers (Gas), Apr. 1961, pp. ii–50, Whirlpool Corporation, St. Joseph, Michigan (Bates Nos. WHR 09854–09908).

Service Manual for RCA Whirlpool Washer–Dryers (Gas), SF–140, Revision 1–60, Jan. 1960, (Bates Nos. WHR 09909–09960).

Hardaway, A. et al., Project Report, "Evaluation of Colgate Palmolive's FAB 1 Shot," Project No. 510330, Report No. 1, pp. 1–15, Whirlpool Corporation Research and Engineering Center, Benton Harbor, Michigan (Bates Nos. WHR 16162–16176).

Fuchs, A., "Water Temperature for Laundering and Automatic Dishwashing," (Bates Nos. WHR 17027–17036).

Karsa, D., "The development of household laundry detergents in Western Europe," *Rev. Prog. Coloration,* vol. 20, 1990, pp. 70–76 (Bates Nos. WHR 17206–17212).

Memo from the desk of Chris Peacock re "Brown Boveri Combo Mfg. for Germany," Whirlpool Corporation (Bates No. WHR 18302).

Photo of "Royal" unit (Bates No. WHR 18303).

Schweitzer, L.F., Press release re 1958 RCA Whirlpool combination washer–dryer available in gas or electric models, Whirlpool Corporation (Bates Nos. WHR 18438–18441).

P.R. Photos, Oct. 1, 1956, Whirlpool–Seeger Corp., Corporate Public Relations, Saint Joseph, Michigan (Bates Nos. WHR 18508–18525).

Freeman, L.C., "Review of RCA Whirlpool Combination Washer–Dryer Model No. 5710500," Whirlpool Corporation (Bates Nos. WHR 18602–18657).

HF620.000 1960 Product Display, Whirlpool Corp. (Bates Nos. WHR 18661–18665).

Product Performance Standard No. B–2, "Combination Washer–Dryer 1965 Kenmore (Water Peel–Off)," pp. 1–9, Whirlpool Corporation, Laundry Engineering Division, St. Joseph, Michigan (Bates Nos. WHR 19990–19998).

Product Performance Standard No. B–13, "Wash'N Dryer 1971 Lady Kenmore (910 Model)," pp. 1–10, Whirpool Corporation, Laundry Engineering Division, St. Joseph, Michigan (Bates Nos. WHR 19999–20008).

Product Performance Standard No. B–15, "Wash'N Dryer 1971 Kenmore (500 Model)," pp. 1–10, Whirlpool Corporation, Laundry Engineering Division, St. Joseph, Michigan (Bates Nos. WHR 20009–20018).

Product Performance Standard No. B–17, "Wash'Dryer 1971 Kenmore (710 Model)," pp. 1–10, Whirlpool Corporation, Laundry Engineering Division, St. Joseph, Michigan (Bates Nos. WHR 20019–20028).

Acceptable Performance Standards No. B–35, "Wash'N Dryers, Model A, Model B, Model C, Model D, Model E," pp. 1–9, Whirlpool Corporation, Laundry Engineering Division, St. Joseph, Michigan (Bates Nos. WHR 20029–20037).

Photograph (Bates No. WHR 20084).

"Now . . . Wash and Dry Clothes in 1 Simple Operation," Aug. 1969, Sears, Roebuck and Co. (Bates Nos. WHR 20085–20086).

Kenmore Washer–Dryer Reference Chart, Part No. 287773, Sears (Bates Nos. WHR 22946–22951).

"Home Laundry Techniques," Sears Roebuck and Co, undated, pp. 1–36 (Bates Nos. WHR 23015–23034).

"KENMORE Home Laundry Equipment, America's Most Welcome Household Servants" Part No. 14266, Sears Roebuck and Co., undated, pp. 1–36 (Bates Nos. WHR 23035–23055).

"From this moment on leisure is your washword! Kenmore Turbo–Matic Washer–Dryer," Part No. 21986, Sears Roebuck and Co, copyright 1956, pp. 1–29 (Bates Nos. WHR 23056–23087).

"From this moment on leisure is your washword! Kenmore Turbo–Matic Washer–Dryer," Part No. 22348, Sears Roebuck and Co, copyright 1957, pp. 1–29 (Bates Nos. WHR 23088–23110).

"Leisure is your washword with KENMORE Combination Washer–Dryer," Part No. 22794, Sears Roebuck and Co. copyright 1958, pp. 1–20 (Bates Nos. WHR 23111–23133).

"Now . . . make washday a Joy instead of a Job: Kenmore Combination Washer–Dryer Manual," Part No. 286525, Sears Roebuck and Co, undated, pp. 1–25 (Bates Nos. WHR 23157–23171).

"Owner's manual for your new washer–dryer," Part No. 287519A, Sears, Roebuck and Co, Chicago, Illinois 60607, undated, pp. 1–33 (Bates Nos. WHR 23191–23209).

"Now . . . make washday a Joy instead of a Job: Kenmore Combination Washer–Dryer Manual," Part No. 287763, Sears Roebuck and Co, undated, pp. 1–25 (Bates Nos. WHR 23210–23224).

"Now . . . make washday a Joy instead of a Job: Kenmore Combination Washer–Dryer Manual," Part No. 287879, Sears Roebuck and Co., undated, pp. 1–25 (Bates Nos. WHR 23225–23239).

"Owner's manual for your new washer–dryer," Part No. 288105, Sears, Roebuck and Co, Chicago, Illinois 60607, undated, pp. 1–25 (Bates Nos. WHR 23259–23273).

"Owner's manual for your new washer–dryer," Part No. 288280, Sears, Roebuck and Co, Chicago, Illinois 60607, undated, pp. 1–25 (Bates Nos. WHR 232938–23307).

"Owner's manual for your new washer–dryer," Part No. 288300, Sears, Roebuck and Co, Chicago, Illinois 60607, undated, pp. 1–33 (Bates Nos. WHR 23308–23326).

"Sears KENMORE laundry guide for your new washer–dryer," Part No. 288301, Sears, Roebuck and Co, Chicago, Illinois 60607, undated, pp. 1–33 (Bates Nos. WHR 23327–23345).

"Sears KENMORE laundry guide for your new washer–dryer," Part No. 288300 Rev. A, Sears, Roebuck and Co, Chicago, Illinois 60607, undated, pp. 1–33 (Bates Nos. WHR 23346–23364).

"Sears KENMORE laundry guide for your new washer–dryer," Part No. 288414, Sears, Roebuck and Co, Chicago, Illinois 60607, undated, pp. 1–25 (Bates Nos. WHR 23384–23398).

"Sears Lady Kenmore Automatic Wash'n Dryer Permanent Press Care," Part No. 288454, Sears, Roebuck and Co., undated (Bates No. WHR 23400).

"Sears Kenmore Automatic Wash'n Dryer Laundry Guide," Part No. 288542, Sears, Roebuck and Co., Chicago, Illinois, 60607, undated, pp. 1–33 (Bates Nos. WHR 23401–23419).

"Hey, Look Me Over! For Years of Happy Laundering with Your New Lady Kenmore Wash 'n Dryer," Part No. 288551, Sears, undated (Bates Nos. WHR 23420–23424).

"Hey, Look Me Over! For Years of Happy Laundering with Your New Lady Kenmore Wash 'n Dryer," Part No. 288615, Sears, undated (Bates Nos. WHR 23425–23429).

"Hey, Look Me Over! For Years of Happy Laundering with Your New Lady Kenmore Wash 'n Dryer," Part No. 288618, Sears, undated, pp. 1–7 (Bates Nos. WHR 23430–23434).
"Complete Laundry Guide and Operating Instructions for your KENMORE," Part No. 296202, Sears Roebuck and Co., Chicago 7, Illinois, undated, pp. 1–25 (Bates Nos. WHR 23435–23449).
"Complete Laundry Guide and Operating Instructions for your KENMORE," Part No. 296684, Sears Roebuck and Co., Chicago 7, Illinois, undated, pp. 1–25 (Bates Nos. WHR 23450–23464).
Revision of instruction booklet for Lady Kenmore Automatic Washer, Part No. 93565, Sears, undated (Bates No. WHR 23469).
"Advance Service Information, Attention Service Managers, Kenmore Laundry Appliances 1967 Models, Release No. 1," Sears Care Protective Maintenance, May 1966 (Bates Nos. WHR 23472–23487).
"The laundry primer especially prepared for owners of new Whirlpool Automatic Washers," Part No. 351962, Whirlpool Corporation, Benton Harbor, Michigan, undated, pp. 1–19 (Bates Nos. WHR 23490–23509).
"RCA Whirlpool Ultimatic washer–dryer," Part No. 286477 (Rev.), Whirlpool Corporation, Benton Harbor, Michigan, undated, pp. 1–27 (Bates Nos. WHR 23512–23526).
"Especially prepared for owners of new RCA Whirlpool Automatic Washers," Part No. 94992, Whirlpool Corporation, Benton Harbor, Michigan, undated, pp. 1–18 (Bates Nos. WHR 23707–23725).
"Your automatic maid . . . day or night, RCA Whirlpool Washer–Dryer Combination Owner's Manual and Warranty," Part No. 22631, Whirlpool Corporation, St. Joseph, Michigan, undated, pp. 1–31 (Bates Nos. WHR 23784–23815).
"Your guide to the most work free washday ever . . . RCA Whirlpool Washer–Dryer Combination Owner's Manual and Warranty," Part No. 23009, Whirlpool Corporation, St. Joseph, Michigan, undated, pp. 1–27 (Bates Nos. WHR 23816–23830).
"Your guide to the most work free washday ever . . . RCA Whirlpool Washer–Dryer Combination Owner's Manual and Warranty," Part No. 23020, Whirlpool Corporation, St. Joseph, Michigan, undated, pp. 1–25 (Bates Nos. WHR 23831–23844).
Parts List for RCA Whirlpool Electric Combination Washer–Dryer Model LKC–9950 W–0, Part No. 89824, pp. 1–11, Whirlpool Corporation, Benton Harbor, Michigan (Bates Nos. WHR 24444–24454).
Temporary Service Parts List for RCA Whirlpool Electric Combination Washer–Dryer Model W5710505, Part No. 99400, pp. 1–10, Whirlpool Corporation, St. Joseph, Michigan (Bates Nos. WHR 24551–24560).
Parts List for Kenmore Gas Combination Washer–Dryer Model 110.5809500, 22502 10–57, pp. 1–11, Sears, Roebuck and Co. (Bates Nos. WHR 26811–26821).
Parts List for Kenmore Electric Combination Washer–Dryer Model 110.5810500, 22529 1–58, pp. 1–9, Simpson–Sears Limited (Bates Nos. WHR 27055–27063).
Parts List for Kenmore Gas Combination Washer–Dryer Model 110.5909500, 22769 10–58, pp. 1–11, Sears, Roebuck and Co. (Bates Nos. WHR 27203–27213).
Parts List for Kenmore Electric Combination Washer–Dryer Model 110.5910500, 22767 9–58, pp. 1–9, Sears, Roebuck and Co. (Bates Nos. WHR 27283–27291).
Parts List for Kenmore Gas Combination Washer–Dryer Model 110.6109500, 286659 4–61, pp. 1–12, Sears, Roebuck and Co. (Bates Nos. WHR 27431–27442).
Parts List for Kenmore Electric Combination Washer–Dryer Model 110.6110500, 286660 6–61, pp. 1–12, Sears, Roebuck and Co. (Bates Nos. WHR 27611–27622).
Parts List for Kenmore Gas Combination Washer–Dryer Model 110.6309800, 287764 9–63, pp. 1–15, Sears, Roebuck and Co. (Bates Nos. WHR 27750–27764).
Parts List for Kenmore Electric Combination Washer–Dryer Model 110.6310800, 287765 9–63, pp. 1–12, Sears, Roebuck and Co. (Bates Nos. WHR 27767–27778).
Parts List for Kenmore Gas Combination Washer–Dryer Model 110.6509900, 287520 9–65, pp. 1–15, Sears, Roebuck and Co. (Bates Nos. WHR 27794–27808).
Parts List for Kenmore Gas Combination Washer–Dryer Model 110.6709500, 288103 4–66, pp. 1–15, Sears, Roebuck and Co. (Bates Nos. WHR 27947–27961).
Parts List for Kenmore Electric Combination Washer–Dryer Model 110.6710501, 288172 7–66, pp. 1–12, Sears, Roebuck and Co. (Bates Nos. WHR 28048–28059).
Parts List for Kenmore Gas Combination Washer–Dryer Model 110.6809500, 288278 Rev. A 10–67, pp. 1–15, Sears, Roebuck and Co. (Bates Nos. WHR 28122–28136).
Parts List for Kenmore Electric Combination Washer–Dryer Model 110.6810500, 288279 Rev. A 10–67, pp. 1–12, Sears, Roebuck and Co. (Bates Nos. WHR 28152–28163).
Parts List for Kenmore Gas Combination Washer–Dryer Model 110.6909500, 288422 10–68, pp. 1–15, Sears, Roebuck and Co. (Bates Nos. WHR 28179–28193).
Parts List for Kenmore Electric Combination Washer–Dryer Model 110.6910500, 288415 Rev. A 10–68, pp. 1–12, Sears, Roebuck and Co. (Bates Nos. WHR 28253–28264).
Parts List for Kenmore Gas Combination Wash'N Dryer Model 110.7109500, 288582 11–70, pp. 1–20, Sears, Roebuck and Co. (Bates Nos. WHR 28303–28322).
Parts List for Kenmore Electric Combination Wash'N Dryer Model 110.7110700, 288570 Rev. A 11–70, pp. 1–18, Sears, Roebuck and Co. (Bates Nos. WHR 28438–28455).
"Washing Machines," *Consumer Reports*, Nov. 1980, pp. 679–684 (Bates Nos. WHR 29044–29049).
Sutton, T., "Project Sequoia Teardown Report—Bosch Siemens," Report File No. 513740–3, Sep. 28, 1992, Whirlpool Corporation, pp. 1–2 (Bates Nos. WHR 31282–31283).
Cool, J., "Bosch–Siemens Auto Positioning Test Results," Report File No. 513740–2, Sep. 27, 1992, Whirlpool Corporation, pp. 1–2 (Bates Nos. WHR 31284–31285).
Mason, T., Memorandum regarding DOE's Technical Support Document, Aug. 17, 1992, pp. 3–10 through 3–20, and A–6 (Bates Nos. WHR 31298–31308).
European Washer Study, Whirlpool Corporation, May 10–24, 1991, pp. 1–14 et seq. (Bates Nos. WHR 31521–31546).
Sanyo Washer/Dryer, Domitechnica, Feb. 1991 (Bates Nos. WHR 31744–31771).
Items Considered in the F.E.A. Energy Calculation, not dated (Bates Nos. WHR 35950–35953).
Lawrenz, W.E., Laboratory Report No. 13002–HD re: Westinghouse Front Loader Automatic Washer, Whirlpool Corporation, St. Joseph, Michigan, Jun. 14, 1977, pp. 1–27 (Bates Nos. WHR 37258–37284).

Lawrenz, W.E., Laboratory Report No. 05063A–3 re: 1976 Wilkins Servis Front Loading Automatic Washer, Whirlpool Corporation, St. Joseph, Michigan, Jun. 22, 1976, pp. 1–19 (Bates Nos. WHR 37286–37304).

Lawrenz, W.E., Laboratory Report No. 05063A–4 re: 1976 Crosley Front Loader Automatic Washer, Whirlpool Corporation, St. Joseph, Michigan, Jun. 7, 1976, pp. 1–20 (Bates Nos. WHR 37318–37337).

Hope, H., et al., Laboratory Report No. 13161–A re: Horizontal Axis Washer—Evaluation of Philco W45 Washability, Whirlpool Corporation, St. Joseph, Michigan, May 18, 1978, pp. 1–16 (Bates Nos. WHR 37349–37354).

Snider, J., Laboratory Report No. 13161–C FINAL re: Performance and Energy Related Data on Several Horizontal Axis Washers, Whirlpool Corporation, St. Joseph, Michigan, May 31, 1978, pp. 1–11 (Bates Nos. WHR 37366–37376).

Lawrenz, W.E., Laboratory Report No. 13161–C–2 re: Water Consumption, Horizontal Axis Washers, Comparison, Whirlpool Corporation, St. Joseph, Michigan, May 30, 1978, pp. 1–7 (Bates Nos. WHR 37377–37383).

Hope, H., et al., Laboratory Report No. 13161–H–2 re: Horizontal Axis Washer Sudsing Characteristics, Whirlpool Corporation, St. Joseph, Michigan, Aug. 28, 1978, pp. 1–19 (Bates Nos. WHR 37435–37453).

Laboratory Report No. 13161–J re: ASTM D1173, Whirlpool Corporation, St. Joseph, Michigan, not dated, pp. 1–2 (Bates Nos. WHR 37455–37456).

Becher, E.J., Memorandum re: Foreign–Made Washer Evaluation Summary, Feb. 19, 1979 (Bates Nos. WHR 40963–40973).

Lawrenz, W.E., Laboratory Report No. 13002–HD re: Westinghouse Front Loader Automatic Washer, Whirlpool Corporation, St. Joseph, Michigan, Jun. 14, 1977, pp. 1–27 (Bates Nos. WHR 43889–43915).

Lawrenz, W.E., Laboratory Report No. 05063A–4 re: 1976 Crosley Front Loader Automatic Washer, Whirlpool Corporation, St. Joseph, Michigan, Jun. 7, 1976, pp. 1–20 (Bates Nos. WHR 44480–44499).

Rutkowski, B.J., et al., Whirlpool Information Network (WIN) Summary No. 74 00512 re: Henkel and Cie's Low Phosphate Heavy Duty Laundry Detegent, Whirlpool Corporation, Jul. 22, 1974 (Bates Nos. WHR 58929–58933).

Rutkowski, B., et al., Whirlpool Information Network (WIN) Summary No. 74 00363 re: SEARS Liquid Laundry Detergent: Dispersed Solvent System, Whirlpool Corporation, May 1, 1974 (Bates Nos. WHR 58944–58950).

Rutkowski, B., et al., Whirlpool Information Network (WIN) Summary No. 74 00361 re: Sears Liquid Laundry Detergent as a Booster in Cold Water Washing, Whirlpool Corporation, Apr. 15, 1974 (Bates Nos. WHR 58951–58952).

Rutkowski, B., et al., Whirlpool Information Network (WIN) Summary No. 74 00358 re: Lab Evaluation of Six Liquid, Non–Phosphate Laundry Detergents, Whirlpool Corporation, Mar. 19, 1974 (Bates Nos. WHR 58953–58957).

Product Information for 9000/1 Series Washing Machines, 1991/1992 Range, Bauknecht, 1992 (Bates Nos. WHR 59088–59108).

Product Information for Waschautomat WA 9000, Bauknecht, Sep. 27, 1988, pp. 1–76 (Bates Nos. WHR 59192–59270).

Service Manual for Washing Machine WA 9350–1, Bauknecht, Whirlpool International Consumer Serivces, May 4, 1982 (Bates Nos. WHR 63262–63277).

"Amazing new RCA Whirlpool Washer–Dryer gets clothes cleaner—saves space—saves water—saves soap," downloaded Jan. 21, 2005, http://www.classicappliances.com/MUSEUM/Whirlpool/Whirlpool–Combo–1958/Pict–Ad.jpg (Bates No. WHR 63413).

"Whirlpool Wing—Classic Appliance Museum," downloaded Jan. 21, 2005, http://www.classicappliances.com/MUSEUM/Whirlpool/Museum–Whirlpool.htm (Bates No. WHR 63414).

Photograph, downloaded Jan. 21, 2005, http://www.classicappliances.com/MUSEUM/Whirlpool/Whirlpool–Combo–1958/Pict–Front.jpg (Bates No. WHR 63415).

Photograph, downloaded Jan. 21, 2005, http://www.classicappliances.com/MUSEUM/Whirlpool/Whirlpool–Combo–1958/Pict–Interior.jpg (Bates No. WHR 63416).

Photograph, downloaded Jan. 21, 2005, http://www.classicappliances.com/MUSEUM/Whirlpool/Whirlpool–Combo–1958/Pict–Controls.jpg (Bates No. WHR 63417).

Here's how your RCA Whirlpool washer–dryer automatically cleans and dries clothes, downloaded Jan. 21, 2005, http://www.classicappliances.com/MUSEUM/Whirlpool/Whirlpool–Combo–1958/Pict–Manual.jpg (Bates No. WHR 63418).

Opinion and Order re Claim Construction, United States District Court for the Western District of Michigan, Southern Division, Case No.: 4:03CV01113, Aug. 2, 2004, pp. 1–40.

Defendants' Prior Art Invalidity Claim Charts, filed with the United States District Court, Western District of Michigan, Southern Division, in Case No.: 4:03CV0113, Oct. 13, 2004, pp. 1–164.

"Sears Division 26 Basic Service Manual Combination Washer–Dryer 1967– , Source 110, Original, Dec. 1967," and which includes Supplement 1, revised May 1972, (Bates Nos. WHR 08184–08333).

"Sears Kenmore Laundry Guide for Your New Washer–Dryer," undated, (Bates Nos. WHR 23365–23383).

"Parts List for Kenmore Electric Combination Washer–Dryer Model 110.6910900," May 1969, (Bates Nos. WHR 28277–28288).

"Sears Kenmore Owner's Manual for Your New Washer–Dryer," undated, (Bates Nos. WHR 23274–23292).

"Parts List for Kenmore Electric Combination Washer–Dryer Model 110.6710700," Aug. 1967, (Bates Nos. WHR 28072–28083).

Attention Service Manager, Laundry Service Manual, vol. IV Combination Washer–Dryer, Supplement No. 5, 1963–1965 Models, Jun. 1964, (Bates Nos. WHR 07908–07975).

"Service Manual for Kenmore Combination Washer Dryers, Turbo–Matic, Gas & Electric Models, Produced Since 1957, Laundry Products, vol. IV," and which includes Jun. 1964 Supplement (Bates Nos. WHR 10049–10390).

"Sears Kenmore Owner's Manual for Your New Washer–Dryer," undated, (Bates Nos. WHR 23172–23190).

"Kenmore Washer–Dryer Reference Chart," undated, (Bates Nos. WHR 22956–22957).

"Parts List for Kenmore Electric Combination Washer–Dryer Model 110.6510900," Oct. 1965, (Bates Nos. WHR 27884–27895).

"Service Manual for RCA–Whirlpool Washer–Dryers (Electric)," Jan. 1960, (Bates Nos. 09612–09652).
"From this Moment on Leisure Is Your Washword! Kenmore Turbo–Matic Washer–Dryer," 1957, (Bates Nos. WHR 23088–23110).
"Service Parts List Supplement for RCA–Whirlpool Electric Combination Washer–Dryer Model W5810503 (EC–50)," Jun. 1959, (Bates Nos. LG 08632–08639).
Rutkowski, "Detergent Evaluation—1969", Nov. 10, 1969, pp. 1–15 (Bates Nos. WHR 03290–3304), Whirlpool Corporation Project Memorandum.
Rutkowski, "Evaluation of Pre–Soak Laundry Products Axion, Amaze, and Biz", Nov. 7, 1968, pp. 1–13 (Bates Nos. WHR 03305–03317), Whirlpool Corporation Project Memorandum.
Rutkowski, "Detergent Evaluation—1968", Sep. 27, 1968, pp. 1–20 (Bates Nos.WHR 03318–03337), Whirlpool Corporation Project Memorandum.
Rutkowski, "Detergency Evaluation Studies", Feb. 22, 1967, Bates Nos. WHR 03338–03381, Whirlpool Corporation Project Authorization.
Rutkowski, "Detergency Evaluation Studies", Jan. 1, 1971, Bates Nos. WHR 03382–03411, Whirlpool Corporation Project Termination.
Rutkowski et al., "Nonphosphate Detergent Studies—1972", pp. 1–19 (Bates Nos. WHR 03412–03432), Dec. 19, 1972, Whirlpool Information Network, Whirlpool Corporation.
Rutkowski et al., "Laundry Detergents—1973", Oct. 25, 1973, pp. 1–13 (Bates Nos. WHR 03433–03446), Whirlpool Corporation Project Report.
Rutkowski et al., "Laundry Detergents—1974", Dec. 3, 1974, pp. 1–11 (Bates Nos. WHR 03447–03458), Whirlpool Corporation Project Report.
Rutkowski et al., "Laundry Detergents—1975", Jan. 13, 1976, pp. 1–16 (Bates Nos. WHR 03459–03475), Whirlpool Corporation Project Report.
Rutkowski et al., "Laundry Detergents—1976", Jan. 26, 1977, pp. 1–21 (Bates Nos. WHR 03476–03497), Whirlpool Corporation Project Report.
Hardaway et al., "Laundry Detergents 1985", May 9, 1986, pp. 1–24 (Bates Nos. WHR 03498–03522), Whirlpool Corporation Project Report.
Hardaway et al., "Liquid Laundry Detergents—1986", Oct. 3, 1986, pp. 1–13 (Bates Nos. WHR 03523–03536), Whirlpool Corporation Project Report.
Hardaway et al., "Powdered Laundry Detergents—1986", Feb. 26, 1987, pp. 1–15 (Bates Nos. WHR 03537–03552), Whirlpool Corporation Project Report.
Kovich et al., "1990 Powder Laundry Detergents", Oct. 17, 1990, pp. 1–12 (Bates Nos. WHR 03553–03567), Whirlpool Corporation Project Report.
Kovich et al., "1990 Liquid Laundry Detergents", Oct. 10, 1990, pp. 1–17 (Bates Nos. WHR 03568–03577), Whirlpool Corporation Information Network (WIN), WIN Summary.
Kovich et al., "1991 Powder Laundry Report", Dec. 17, 1991, pp. 1–11 (Bates Nos. WHR 03578–03591), Whirlpool Corporation Information Network (WIN), WIN Summary.
Kovich et al., "1991 Liquid Laundry Report", Dec. 18, 1991, pp. 1–7 (Bates Nos. WHR 03592–03601), Whirlpool Corporation Project Report.
Rutkowski, "Laboratory Evaluation of Laundry Detergents—Non Phosphate and Low Phosphate Detergent", (date illegible), Bates Nos. WHR 09251–09306), Whirlpool Corporation Information Network (WIN), WIN Summary.
Rutkowski, "Detergent Evaluation—1969", Nov. 10, 1969, pp. 1–15 (Bates Nos. WHR 09307–09321), Whirlpool Corporation Project Memorandum.
Rutkowski, "Detergent Evaluation—1968", Sep. 27, 1968, pp. 1–20 (Bates Nos. WHR 09322–03341), Whirlpool Corporation Project Memorandum.
Rutkowski, "Detergent Evaluation Test Procedures Laboratory vs. Practical Methods", Jan. 4, 1968, pp. 1–17 (Bates Nos. WHR 09342–09358), Whirlpool Corporation Project Memorandum.
Rutkowski, "Evaluation of Pre–Soak Laundry Products Axion, Amaze, and Biz", Nov. 7, 1968, pp. 1–13 (Bates Nos. WHR 09359–09371), Whirlpool Corporation Project Memorandum.
Whirlpool Washer–Dryer Combination Owner's Manual and Warranty, (Bates Nos. LG 06318–06349).
File history of US Patent 5,219,718, granted Aug. 10, 1993, inventors Hardaway et al., (Bates Nos. WHR 00288–00414).
File history of European Patent Application 92311795.6, Whirlpool Corporation, (Bates Nos. WHR 00551–00699).
"Sears KENMORE laundry guide for you new washer–dryer", undated (Bates Nos. LG 06503–06538).

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 13–15, 18, 19, 21 and 22 are cancelled.

Claims 1, 4, 6, 16, 17 and 20 are determined to be patentable as amended.

Claims 2, 3, 5 and 7–12, dependent on an amended claim, are determined to be patentable.

New claim 23 is added and determined to be patentable.

1. A method of rinsing fabric in a washer having a wash chamber rotatable about a horizontal axis, comprising the steps:

(a) loading fabric to be washed into the wash chamber of said washer;

(b) washing said fabric in a concentrated detergent solution of at least 0.5% detergent by weight while rotating said wash chamber about said horizontal axis for a first *washing* period of time; *wherein step (b) comprises:*

*(i) rotating said wash chamber such that said fabric will tumble in said wash chamber;*

*(ii) directing a recirculating spray of concentrated detergent solution having a concentration level in the range of 0.5 to 12% detergent by weight onto said tumbling fabric for a first period of time;*

*(iii) terminating the tumbling of the fabric and the recirculating spray;*

*(iv) thereafter diluting said concentrated detergent solution to a lesser detergent concentration level, no less than 0.28% by weight, and rotating said wash chamber such that said fabric will again tumble in said wash chamber; and*

*(v) directing a recirculating spray of said lesser concentrated detergent solution onto said tumbling fabric for a second period of time;*

(c) draining said *lesser* concentrated detergent solution from said wash chamber subsequent to said first *washing* period of time while spinning said wash chamber at a speed to effect more than a one gravity centrifugal force on said fabric such that said fabric will not tumble within said wash chamber as it spins;

(d) rinsing said fabric by spraying water directly onto said fabric and recirculating water to said wash chamber by spraying said recirculating water directly onto said fabric while spinning said wash chamber at a speed to effect less than a one gravity centrifugal force on said fabric such that said fabric will tumble within said wash chamber as it spins;

(e) draining said wash chamber of said rinse water while spinning said wash chamber at a speed to effect more than a one gravity centrifugal force on said fabric such that said fabric will not tumble within said wash chamber as it spins; and (f) repeating steps (d) and (e) a predetermined number of times.

4. A method of [rinse] *rinsing* fabric in a washer according to claim 1 wherein each of said recirculation cycles uses approximately one gallon of water.

6. A method of rinsing fabric washed in a concentrated detergent solution in a washer having a wash chamber rotatable about a horizontal axis comprising the steps of:

*(a) washing the fabric in the concentrated detergent solution, the concentrated detergent solution having a concentration level in the range of 0.5 to 12% detergent by weight, this washing step comprising:*

*(i) rotating said wash chamber such that said fabric will tumble in said wash chamber;*

*(ii) initially wetting the fabric with the concentrated detergent solution;*

*(iii) directing a recirculating spray of the concentrated detergent solution onto said tumbling fabric for a first period of time;*

*(iv) thereafter diluting said concentrated detergent solution to a lesser detergent concentration level, no less than 0.28% by weight, and rotating said wash chamber such that said fabric will again tumble in said wash chamber;*

*(v) directing a recirculating spray of said lesser concentrated detergent solution onto said tumbling fabric for a second period of time;*

([a]*b*) rinsing said fabric by adding water by spraying water directly onto said fabric and recirculating water by spraying water directly onto said fabirc to and within said wash chamber while spinning said wash chamber at a speed to effect less than a one gravity centrifugal force on said fabric such that said fabric will tumble within said wash chamber as it spins;

([b]*c*) draining said wash chamber of said rinse water; and ([c]*d*) repeating steps ([a]*b*) and ([b]*c*) a predetermined number of times.

16. A method of rinsing fabric in a washer according to claim [15] *1* wherein there are at least 6 of said rinsing, recirculating, and draining steps.

17. A method of rinsing fabric in a washer according to claim [15] *1* wherein there are no more than 12 of said rinsing, recirculating, and draining steps.

20. A method of rinsing fabric in a washer according to claim [15] *6* wherein there are at least 6 and no more than 12 of said rinsing and draining steps and further wherein each said rinsing step further comprises spraying approximately one gallon of said water directly onto the tumbling clothes.

*23. A method of rinsing fabric in a washer having a wash chamber rotatable about a horizontal axis, comprising the steps:*

*(a) loading fabric to be washed into the wash chamber of said washer;*

*(b) washing said fabric in a concentrated detergent solution of at least 0.5% detergent by weight while rotating said wash chamber about said horizontal axis for a first washing period of time; wherein step (b) comprises:*

*(i) rotating said wash chamber such that said fabric will tumble in said wash chamber;*

*(ii) directing a recirculating spray of the concentrated detergent solution onto said tumbling fabric for a first period of time, wherein the recirculating spray*

*of concentrated detergent solution begins prior to any draining of the wash chamber;*

(*iii*) *thereafter diluting said concentrated detergent solution to a lesser detergent concentration level, no less than 0.28% by weight, and rotating said wash chamber such that said fabric will again tumble in said wash chamber;*

(*iv*) *directing a recirculating spray of said lesser concentrated detergent solution onto said tumbling fabric for a second period of time;*

(*c*) *draining said lesser concentrated detergent solution from said wash chamber subsequent to said first washing period of time while spinning said wash chamber at a speed to effect more than a one gravity centrifugal force on said fabric such that said fabric will not tumble within said wash chamber as it spins;*

(*d*) *rinsing said fabric by spraying water directly onto said fabric and recirculating water to said wash chamber by spraying said recirculating water directly onto said fabric while spinning said wash chamber at a speed to effect less than a one gravity centrifugal force on said fabric such that said fabric will tumble within said wash chamber as it spins;*

(*e*) *draining said wash chamber of said rinse water while spinning said wash chamber at a speed to effect more than a one gravity centrifugal force on said fabric such that said fabric will not tumble within said wash chamber as it spins; and*

(*f*) *repeating steps* (*d*) *and* (*e*) *a predetermined number of times.*

* * * * *